US009060562B2

(12) United States Patent
Meir et al.

(10) Patent No.: US 9,060,562 B2
(45) Date of Patent: Jun. 23, 2015

(54) METHOD OF KNITTING A KNITTED COMPONENT WITH AN INTEGRAL KNIT TONGUE

(71) Applicant: Nike, Inc., Beaverton, OR (US)

(72) Inventors: Adrain Meir, Portland, OR (US); Daniel A. Podhajny, Beaverton, OR (US); Daren P. Tatler, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 141 days.

(21) Appl. No.: 13/781,551

(22) Filed: Feb. 28, 2013

(65) Prior Publication Data

US 2013/0239625 A1 Sep. 19, 2013

Related U.S. Application Data

(63) Continuation-in-part of application No. 13/400,511, filed on Feb. 20, 2012, now Pat. No. 8,448,474.

(51) Int. Cl.
*D04B 7/30* (2006.01)
*A43B 1/04* (2006.01)
(Continued)

(52) U.S. Cl.
CPC ... *A43B 1/04* (2013.01); *D04B 1/24* (2013.01); *A43B 23/0245* (2013.01); *A43B 23/0265* (2013.01); *A43B 23/26* (2013.01); *D04B 1/22* (2013.01); *D04B 15/56* (2013.01); *D10B 2403/02411* (2013.01); *D10B 2403/032* (2013.01); *D10B 2501/043* (2013.01); *A43B 23/0205* (2013.01); *D04B 7/28* (2013.01); *D10B 2403/0113* (2013.01)

(58) Field of Classification Search
CPC ..... D04B 1/24; D04B 2401/043; D04B 2403/032; A43B 1/04; A43B 23/0245; A43B 23/26
USPC ..... 66/169 R, 170, 171, 177; 2/3 R, 3 A, 84, 2/114, 47
See application file for complete search history.

(56) References Cited

U.S. PATENT DOCUMENTS 601,192 A 3/1898 Woodside
1,215,198 A 2/1917 Rothstein
(Continued)

FOREIGN PATENT DOCUMENTS

CN 1782156 6/2006
CN 102271548 12/2011
(Continued)

OTHER PUBLICATIONS

Declaration of Dr. Edward C. Frederick from the US Patent and Trademark Office Inter Partes Review of US Patent No. 7,347,011 (178 pp).
(Continued)

*Primary Examiner* — Danny Worrell
(74) *Attorney, Agent, or Firm* — Plumsea Law Group, LLC

(57) ABSTRACT

Methods of manufacturing a knitted component for an article of footwear that include knitting an upper with an integral knit tongue during a knitting process on a knitting machine are described. The knitting process forms the integral knit tongue of unitary knit construction with the upper so that the integral knit tongue extends through a throat area of the knitted component. The integral knit tongue can include raised elements formed of unitary knit construction with the tongue.

23 Claims, 28 Drawing Sheets

(51) Int. Cl.

| | |
|---|---|
| ***D04B 1/24*** | (2006.01) |
| ***A43B 23/02*** | (2006.01) |
| ***A43B 23/26*** | (2006.01) |
| ***D04B 1/22*** | (2006.01) |
| ***D04B 15/56*** | (2006.01) |
| ***D04B 7/28*** | (2006.01) |

(56) References Cited

U.S. PATENT DOCUMENTS

| | | | |
|---|---|---|---|
| 1,597,934 | A | 8/1926 | Stimpson |
| 1,888,172 | A | 11/1932 | Joha |
| 1,902,780 | A | 3/1933 | Holden |
| 1,910,251 | A | 5/1933 | Joha |
| 2,001,293 | A | 5/1935 | Wilson |
| 2,047,724 | A | 7/1936 | Zuckerman |
| 2,147,197 | A | 2/1939 | Glidden |
| 2,314,098 | A | 3/1943 | McDonald |
| 2,330,199 | A | 9/1943 | Basch |
| 2,343,390 | A | 3/1944 | Ushakoff |
| 2,400,692 | A | 5/1946 | Herbert |
| 2,440,393 | A | 4/1948 | Clark |
| 2,569,764 | A | 10/1951 | Jonas |
| 2,586,045 | A | 2/1952 | Hoza |
| 2,608,078 | A | 8/1952 | Anderson |
| 2,641,004 | A | 6/1953 | Whiting et al. |
| 2,675,631 | A | 4/1954 | Doughty |
| 3,694,940 | A | 10/1972 | Stohr |
| 3,704,474 | A | 12/1972 | Winkler |
| 3,766,566 | A | 10/1973 | Tadokoro |
| 3,778,856 | A | 12/1973 | Christie |
| 3,583,081 | A | 6/1974 | Hayashi |
| 3,952,427 | A | 4/1976 | Von den Benken |
| 3,972,086 | A | 8/1976 | Belli |
| 4,027,402 | A | 6/1977 | Liu |
| 4,031,586 | A | 6/1977 | Von den Benken |
| 4,211,806 | A | 7/1980 | Civardi |
| 4,255,949 | A | 3/1981 | Thorneburg |
| 4,317,292 | A | 3/1982 | Melton |
| 4,373,361 | A | 2/1983 | Thorneburg |
| 4,447,967 | A | 5/1984 | Zaino |
| 4,465,448 | A | 8/1984 | Aldridge |
| 4,499,741 | A | 2/1985 | Harris |
| 4,607,439 | A | 8/1986 | Sogabe et al. |
| 4,737,396 | A | 4/1988 | Kamat |
| 4,750,339 | A | 6/1988 | Simpson et al. |
| 4,756,098 | A | 7/1988 | Boggia |
| 4,785,558 | A | 11/1988 | Shiomura |
| 4,813,158 | A | 3/1989 | Brown |
| 5,095,720 | A | 3/1992 | Tibbals |
| 5,152,025 | A | 10/1992 | Hirmas |
| 5,192,601 | A | 3/1993 | Neisler |
| 5,345,638 | A | 9/1994 | Nishida |
| 5,353,524 | A | 10/1994 | Brier |
| 5,461,884 | A | 10/1995 | McCartney |
| 5,511,323 | A | 4/1996 | Dahlgren |
| 5,572,860 | A | 11/1996 | Mitsumoto |
| 5,575,090 | A | 11/1996 | Condini |
| 5,729,918 | A | 3/1998 | Smets |
| 5,735,145 | A | 4/1998 | Pernick |
| 5,746,013 | A | 5/1998 | Fay |
| 5,823,012 | A | 10/1998 | Hacskaylo |
| 6,308,438 | B1 | 10/2001 | Throneburg |
| 6,321,574 | B1 | 11/2001 | Marker et al. |
| 6,333,105 | B1 | 12/2001 | Tanaka et al. |
| 6,401,364 | B1 | 6/2002 | Burt |
| 6,558,784 | B1 | 5/2003 | Norton |
| 6,588,237 | B2 | 7/2003 | Cole |
| 6,910,288 | B2 | 6/2005 | Dua |
| 6,931,762 | B1 | 8/2005 | Dua |
| 7,051,460 | B2 | 5/2006 | Orei |
| 7,056,402 | B2 | 6/2006 | Koerwien |
| 7,347,011 | B2 | 3/2008 | Dua |
| 7,441,348 | B1 | 10/2008 | Dawson |
| 7,682,219 | B2 | 3/2010 | Falla |
| 7,752,775 | B2 | 7/2010 | Lyden |
| 7,770,306 | B2 | 8/2010 | Lyden |
| 7,774,956 | B2 | 8/2010 | Dua |
| 7,814,598 | B2 | 10/2010 | Dua |
| 8,196,317 | B2 | 6/2012 | Dua |
| 8,215,033 | B2 | 7/2012 | Carboy |
| 8,225,530 | B2 | 7/2012 | Sokolowski |
| 8,266,749 | B2 | 9/2012 | Dua |
| 8,490,299 | B2 * | 7/2013 | Dua et al. ..... 36/50.1 |
| 8,621,891 | B2 * | 1/2014 | Dua et al. ..... 66/177 |
| 8,650,916 | B2 * | 2/2014 | Dua et al. ..... 66/177 |
| 8,745,895 | B2 * | 6/2014 | Sokolowski et al. ..... 36/50.1 |
| 8,800,172 | B2 * | 8/2014 | Dua et al. ..... 36/50.1 |
| 2002/0078599 | A1 | 6/2002 | Delgorgue |
| 2002/0148258 | A1 | 10/2002 | Cole et al. |
| 2003/0126762 | A1 | 7/2003 | Tseng |
| 2003/0191427 | A1 | 10/2003 | Jay |
| 2003/0200679 | A1 | 10/2003 | Wilson |
| 2004/0118018 | A1 | 6/2004 | Dua |
| 2005/0115284 | A1 | 6/2005 | Dua |
| 2005/0193592 | A1 | 9/2005 | Dua |
| 2005/0284000 | A1 | 12/2005 | Kerns |
| 2007/0180730 | A1 | 8/2007 | Greene |
| 2007/0294920 | A1 | 12/2007 | Baychar |
| 2008/0017294 | A1 | 1/2008 | Bailey |
| 2008/0110048 | A1 | 5/2008 | Dua |
| 2008/0189830 | A1 | 8/2008 | Egglesfield |
| 2008/0313939 | A1 | 12/2008 | Ardill |
| 2009/0068908 | A1 | 3/2009 | Hinchcliff |
| 2010/0051132 | A1 | 3/2010 | Glenn |
| 2010/0154256 | A1 | 6/2010 | Dua |
| 2010/0170651 | A1 | 7/2010 | Scherb |
| 2011/0078921 | A1 | 4/2011 | Greene |
| 2011/0185592 | A1 | 8/2011 | Nishiwaki |
| 2012/0011744 | A1 | 1/2012 | Bell |
| 2012/0233882 | A1 | 9/2012 | Huffa |
| 2012/0233884 | A1 | 9/2012 | Greene |
| 2012/0240429 | A1 | 9/2012 | Sokolowski |
| 2012/0255201 | A1 | 10/2012 | Little |

FOREIGN PATENT DOCUMENTS

| | | | |
|---|---|---|---|
| DE | 870963 | C | 3/1953 |
| DE | 1084173 | | 6/1960 |
| DE | 19738433 | | 4/1998 |
| DE | 19728848 | | 1/1999 |
| EP | 0448714 | | 10/1991 |
| EP | 0728860 | | 8/1996 |
| EP | 0758693 | | 2/1997 |
| EP | 1233091 | | 8/2002 |
| EP | 1563752 | A1 | 8/2005 |
| FR | 2171172 | | 9/1973 |
| GB | 538865 | | 8/1941 |
| GB | 1603487 | | 11/1981 |
| JP | H06113905 | | 4/1994 |
| JP | H08109553 | | 4/1996 |
| JP | H11302943 | | 11/1999 |
| JP | 2005160697 | | 6/2005 |
| NL | 7304678 | | 10/1974 |
| WO | 9003744 | | 4/1990 |
| WO | 0032861 | | 6/2000 |
| WO | 0231247 | | 4/2002 |
| WO | 2013126313 | | 8/2013 |

OTHER PUBLICATIONS

David J. Spencer, Knitting Technology: A Comprehensive Handbook and Practical Guide (Third ed., Woodhead Publishing Ltd. 2001) (413 pp).

Excerpt of Hannelore Eberle et al., Clothing Technology (Third English ed., Beuth-Verlag GmnH 2002) (book cover and back; pp. 2-3, 83).

(56) References Cited

OTHER PUBLICATIONS

Letter from Bruce Huffa dated Dec. 23, 2013 (71 pages).
Non-Final Office Action mailed Oct. 17, 2012 in U.S. Appl. No. 13/400,511.
Non-Final Office Action mailed Dec. 19, 2012 in U.S. Appl. No. 13/474,531.
Notice of Allowance mailed Jan. 31, 2013 in U.S. Appl. No. 13/400,511.
International Search Report and Written Opinion mailed Jul. 30, 2014 in International Application No. PCT/US2014/018845.
Taiwanese Office Action dated Nov. 14, 2014 in Taiwanese Patent Application No. 102105769.
International Search Report and Written Opinion mailed Jun. 20, 2014 in International Application No. PCT/US2014/018852.

* cited by examiner

METHOD OF KNITTING A KNITTED COMPONENT WITH AN INTEGRAL KNIT TONGUE

CROSS-REFERENCE TO RELATED APPLICATION

This application is a continuation-in-part of co-pending U.S. patent application Ser. No. 13/400,511, entitled "Article Of Footwear Incorporating A Knitted Component With A Tongue", filed on Feb. 20, 2012, which application is hereby incorporated by reference in its entirety.

BACKGROUND

The present invention relates generally to methods of manufacturing articles of footwear, and, in particular, to a knitting process for a knitted component with an integral knit tongue for an article of footwear.

Conventional articles of footwear generally include two primary elements, an upper and a sole structure. The upper is secured to the sole structure and forms a void on the interior of the footwear for comfortably and securely receiving a foot. The sole structure is secured to a lower area of the upper, thereby being positioned between the upper and the ground. In athletic footwear, for example, the sole structure may include a midsole and an outsole. The midsole often includes a polymer foam material that attenuates ground reaction forces to lessen stresses upon the foot and leg during walking, running, and other ambulatory activities. Additionally, the midsole may include fluid-filled chambers, plates, moderators, or other elements that further attenuate forces, enhance stability, or influence the motions of the foot. The outsole is secured to a lower surface of the midsole and provides a ground-engaging portion of the sole structure formed from a durable and wear-resistant material, such as rubber. The sole structure may also include a sockliner positioned within the void and proximal a lower surface of the foot to enhance footwear comfort.

The upper generally extends over the instep and toe areas of the foot, along the medial and lateral sides of the foot, under the foot, and around the heel area of the foot. In some articles of footwear, such as basketball footwear and boots, the upper may extend upward and around the ankle to provide support or protection for the ankle. Access to the void on the interior of the upper is generally provided by an ankle opening in a heel region of the footwear. A lacing system is often incorporated into the upper to adjust the fit of the upper, thereby permitting entry and removal of the foot from the void within the upper. The lacing system also permits the wearer to modify certain dimensions of the upper, particularly girth, to accommodate feet with varying dimensions. In addition, the upper may include a tongue that extends under the lacing system to enhance adjustability of the footwear, and the upper may incorporate a heel counter to limit movement of the heel.

A variety of material elements (e.g., textiles, polymer foam, polymer sheets, leather, synthetic leather) are conventionally used in manufacturing the upper. In athletic footwear, for example, the upper may have multiple layers that each include a variety of joined material elements. As examples, the material elements may be selected to impart stretch-resistance, wear-resistance, flexibility, air-permeability, compressibility, comfort, and moisture-wicking to different areas of the upper. In order to impart the different properties to different areas of the upper, material elements are often cut to desired shapes and then joined together, usually with stitching or adhesive bonding. Moreover, the material elements are often joined in a layered configuration to impart multiple properties to the same areas. As the number and type of material elements incorporated into the upper increases, the time and expense associated with transporting, stocking, cutting, and joining the material elements may also increase. Waste material from cutting and stitching processes also accumulates to a greater degree as the number and type of material elements incorporated into the upper increases. Moreover, uppers with a greater number of material elements may be more difficult to recycle than uppers formed from fewer types and numbers of material elements. By decreasing the number of material elements used in the upper, therefore, waste may be decreased while increasing the manufacturing efficiency and recyclability of the upper.

Therefore, there exists a need for an article of footwear that incorporates a knitted component with an integral knit tongue.

SUMMARY

Various configurations of an article of footwear may have an upper and a sole structure secured to the upper. A knitted component including the upper and an integral knit tongue is incorporated into the article of footwear. The upper and the integral knit tongue are formed as a one-piece knit element. The knit element defines a portion of an exterior surface of the upper and an opposite interior surface of the upper, with the interior surface defining a void for receiving a foot. The integral knit tongue is formed of unitary knit construction with the upper as a one-piece knit element and extends through a throat area of the upper. The integral knit tongue incorporates raised elements providing lace apertures for a lacing system.

In one aspect, the invention provides a method of manufacturing a knitted component for an article of footwear, the method comprising: knitting a portion of the knitted component defining an upper with a knitting machine, the upper including a portion of at least one of an exterior surface of the knitted component and an opposite interior surface of the knitted component; and knitting an integral knit tongue that is of unitary knit construction with the upper with the knitting machine, the integral knit tongue extending through a throat area of the knitted component; and wherein the integral knit tongue is joined by knitting with the knitting machine to a forward portion of the throat area and at least along a portion of a lateral side and a medial side of the throat area of the knitted component extending from the forward portion to an ankle opening of the upper.

In another aspect, the invention provides a method of manufacturing a knitted component for an article of footwear, the method comprising: knitting a first portion of the knitted component defining an upper with a first feeder of a knitting machine, the upper including a portion of at least one of an exterior surface of the knitted component and an opposite interior surface of the knitted component; knitting a second portion of the knitted component defining the upper with a second feeder of the knitting machine; and knitting an integral knit tongue that is of unitary knit construction with the upper with at least one of the first feeder and the second feeder of the knitting machine, the integral knit tongue extending through a throat area of the knitted component; and wherein the integral knit tongue is joined by knitting with the knitting machine to a forward portion of the throat area and at least along a portion of a lateral side and a medial side of the throat area of the knitted component extending from the forward portion to an ankle opening of the upper.

In another aspect, the invention provides a method of manufacturing a knitted component for an article of footwear, the method comprising: knitting a first portion of the knitted component defining an upper with a first feeder of a knitting machine, the upper including a portion of at least one of an exterior surface of the knitted component and an opposite interior surface of the knitted component; knitting a second portion of the knitted component defining the upper with a second feeder of the knitting machine; and knitting an integral knit tongue that is of unitary knit construction with the upper with a third feeder of the knitting machine, the integral knit tongue extending through a throat area of the knitted component; and wherein the integral knit tongue is joined by knitting with the knitting machine to a forward portion of the throat area and at least along a portion of a lateral side and a medial side of the throat area of the knitted component extending from the forward portion to an ankle opening of the upper.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

The following discussion and accompanying figures disclose a variety of concepts relating to knitted components and the manufacture of knitted components. Although the knitted components may be used in a variety of products, an article of footwear that incorporates one of the knitted components is disclosed below as an example. In addition to footwear, the knitted components may be used in other types of apparel (e.g., shirts, pants, socks, jackets, undergarments), athletic equipment (e.g., golf bags, baseball and football gloves, soccer ball restriction structures), containers (e.g., backpacks, bags), and upholstery for furniture (e.g., chairs, couches, car seats). The knitted components may also be used in bed coverings (e.g., sheets, blankets), table coverings, towels, flags, tents, sails, and parachutes. The knitted components may be used as technical textiles for industrial purposes, including structures for automotive and aerospace applications, filter materials, medical textiles (e.g. bandages, swabs, implants), geotextiles for reinforcing embankments, agrotextiles for crop protection, and industrial apparel that protects or insulates against heat and radiation. Accordingly, the knitted components and other concepts disclosed herein may be incorporated into a variety of products for both personal and industrial purposes.

Footwear Configurations

FIGS. 1 through 15 illustrate various footwear configurations according to the principles described and illustrated herein. In particular, FIGS. 1-4B illustrate an exemplary embodiment of an article of footwear incorporating a knitted component including an upper and an integral knit tongue.

FIGS. 1 through 4B illustrate an exemplary embodiment of an article of footwear 100, also referred to simply as footwear 100. In some embodiments, article of footwear 100 may include a sole structure 110 and an upper 120. Although footwear 100 is illustrated as having a general configuration suitable for running, concepts associated with footwear 100 may also be applied to a variety of other athletic footwear types, including baseball shoes, basketball shoes, cycling shoes, football shoes, tennis shoes, soccer shoes, training shoes, walking shoes, and hiking boots, for example. The concepts may also be applied to footwear types that are generally considered to be non-athletic, including dress shoes, loafers, sandals, and work boots. Accordingly, the concepts disclosed with respect to footwear 100 may be applied to a wide variety of footwear types.

Figure 1:
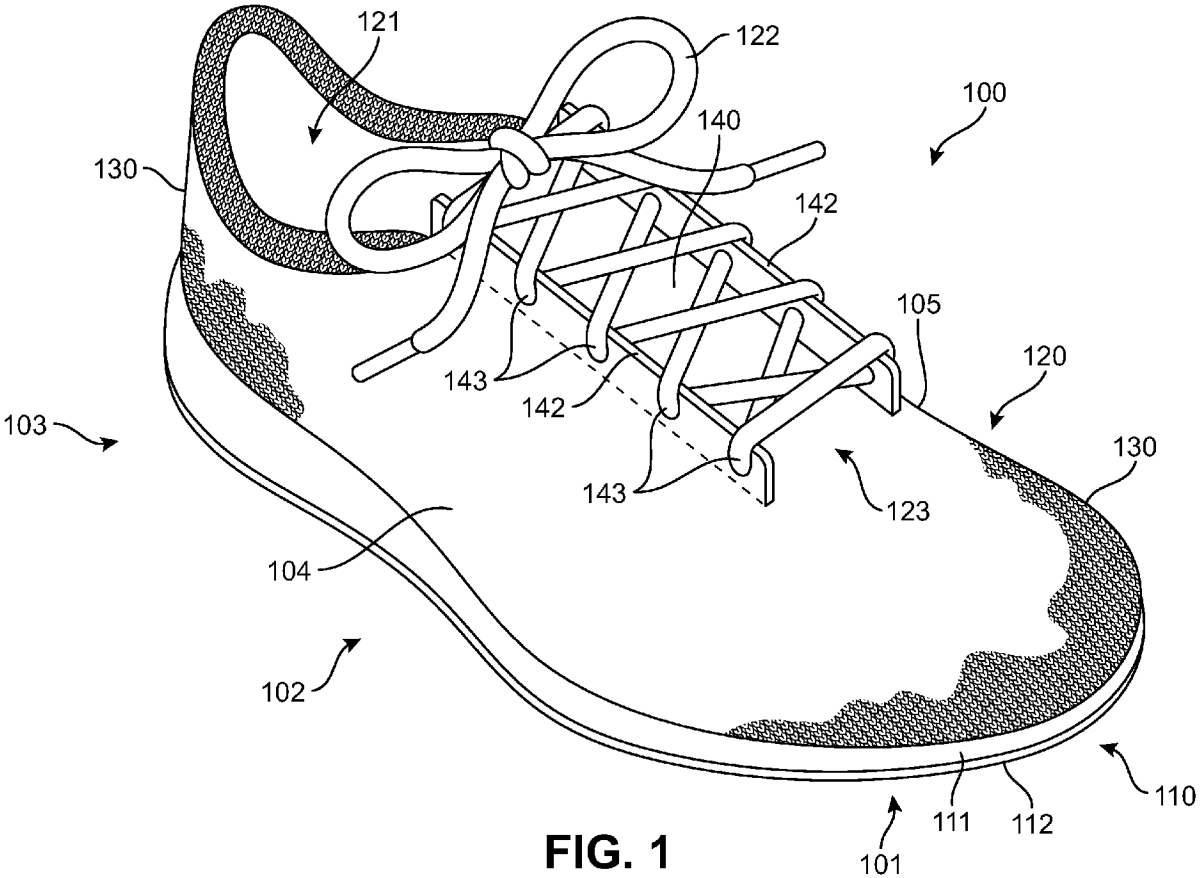
FIG. 1 is an isometric view of an exemplary embodiment of an article of footwear.
Figure 2:
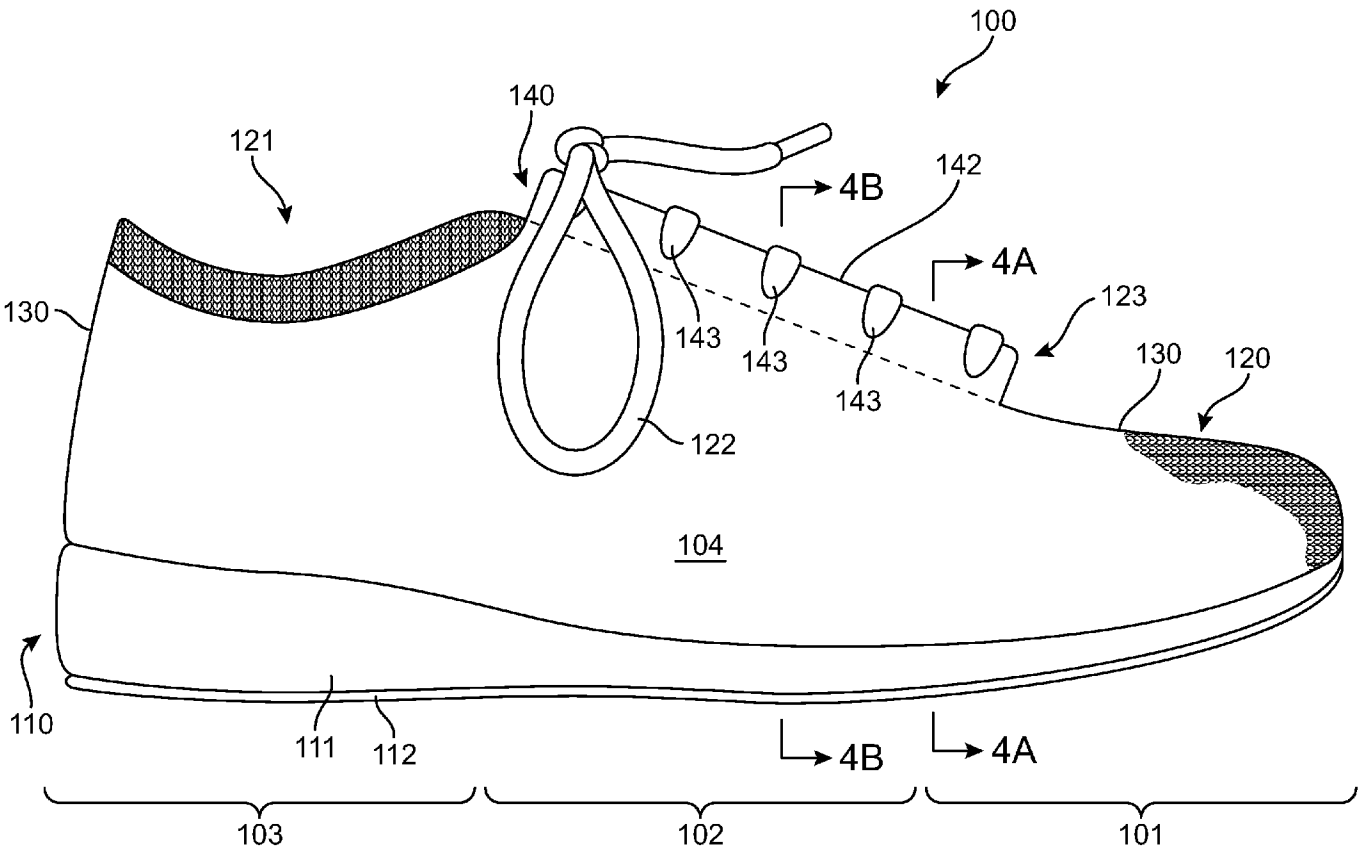
FIG. 2 is a lateral side view of an exemplary embodiment of an article of footwear.
Figure 3:
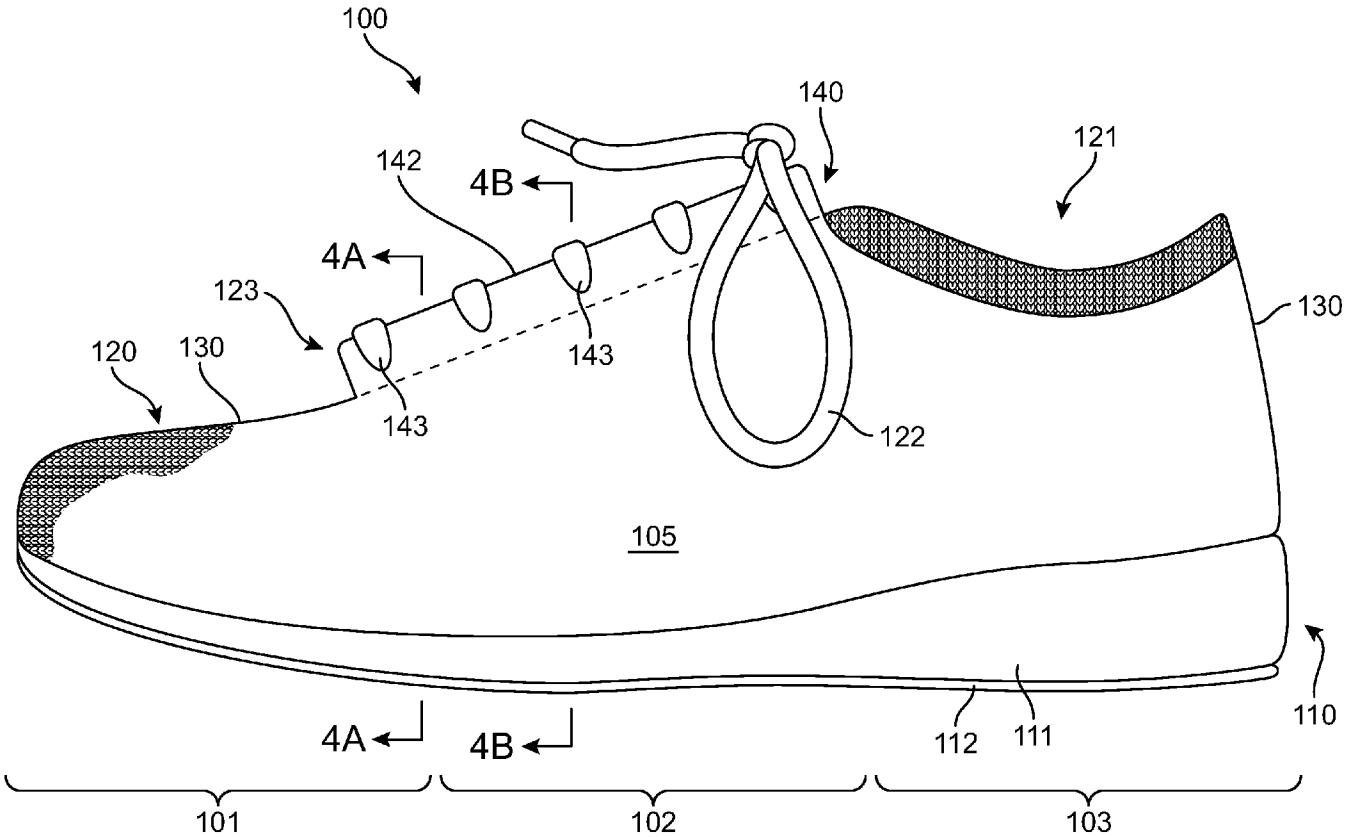
FIG. 3 is a medial side view of an exemplary embodiment of an article of footwear.

For reference purposes, footwear 100 may be divided into three general regions: a forefoot region 101, a midfoot region 102, and a heel region 103, as shown in FIGS. 1, 2, and 3. Forefoot region 101 generally includes portions of footwear 100 corresponding with the toes and the joints connecting the metatarsals with the phalanges. Midfoot region 102 generally includes portions of footwear 100 corresponding with an arch area of the foot. Heel region 103 generally corresponds with rear portions of the foot, including the calcaneus bone. Footwear 100 also includes a lateral side 104 and a medial side 105, which extend through each of forefoot region 101, midfoot region 102, and heel region 103 and correspond with opposite sides of footwear 100. More particularly, lateral side 104 corresponds with an outside area of the foot (i.e., the surface that faces away from the other foot), and medial side 105 corresponds with an inside area of the foot (i.e., the surface that faces toward the other foot). Forefoot region 101, midfoot region 102, and heel region 103 and lateral side 104, medial side 105 are not intended to demarcate precise areas of footwear 100. Rather, forefoot region 101, midfoot region 102, and heel region 103 and lateral side 104, medial side 105 are intended to represent general areas of footwear 100 to aid in the following discussion. In addition to footwear 100, forefoot region 101, midfoot region 102, and heel region 103 and lateral side 104, medial side 105 may also be applied to sole structure 110, upper 120, and individual elements thereof.

In an exemplary embodiment, sole structure 110 is secured to upper 120 and extends between the foot and the ground when footwear 100 is worn. In some embodiments, the primary elements of sole structure 110 are a midsole 111, an outsole 112, and a sockliner 113 (shown in FIGS. 4A and 4B). Midsole 111 is secured to a lower surface of upper 120 and may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In other embodiments, midsole 111 may incorporate plates, moderators, fluid-filled chambers, lasting elements, or motion control members that further attenuate forces, enhance stability, or influence the motions of the foot, or midsole 111 may be primarily formed from a fluid-filled chamber. Outsole 112 is secured to a lower surface of midsole 111 and may be formed from a wear-resistant rubber material that is textured to impart traction. Sockliner 113 is located within upper 120 and is positioned to extend under a lower surface of the foot to enhance the comfort of footwear 100. Although this configuration for sole structure 110 provides an example of a sole structure that may be used in connection with upper 120, a variety of other conventional or nonconventional configurations for sole structure 110 may also be used. Accordingly, in other embodiments, the features of sole structure 110 or any sole structure used with upper 120 may vary.

In some embodiments, upper 120 defines a void within footwear 100 for receiving and securing a foot relative to sole structure 110. The void is shaped to accommodate the foot and extends along a lateral side of the foot, along a medial side of the foot, over the foot, around the heel, and under the foot. Access to the void is provided by an ankle opening 121 located in at least heel region 103. In some embodiments, a throat area 123 extends from ankle opening 121 in heel region 103 over an area corresponding to an instep of the foot to an area adjacent to forefoot region 101. In an exemplary embodiment, an integral knit tongue 140 is formed of unitary knit construction with upper 120 and extends through throat area 123 of upper 120 between lateral side 104 and medial side 105.

A lace 122 extends through various lace apertures 143 in raised elements 142 of integral knit tongue 140 and permits the wearer to modify dimensions of upper 120 to accommodate proportions of the foot. More particularly, lace 122 permits the wearer to tighten upper 120 around the foot, and lace 122 permits the wearer to loosen upper 120 to facilitate entry and removal of the foot from the void (i.e., through ankle opening 121). In addition, integral knit tongue 140 of upper 120 extends under lace 122 to enhance the comfort of footwear 100. In further configurations, upper 120 may include additional elements, such as (a) a heel counter in heel region 103 that enhances stability, (b) a toe guard in forefoot region 101 that is formed of a wear-resistant material, and (c) logos, trademarks, and placards with care instructions and material information.

Figure 4A:
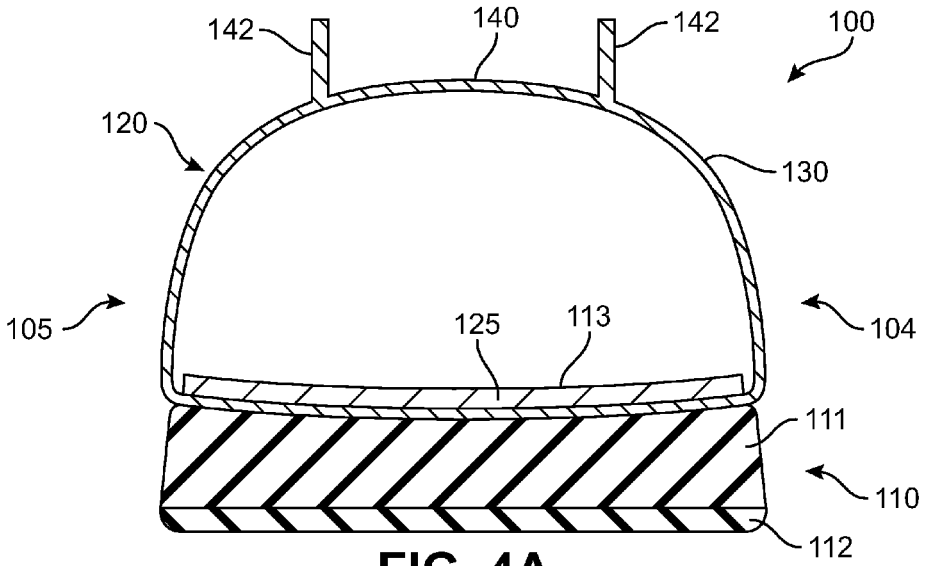
FIG. 4A is a cross-sectional view of the article of footwear, as defined by section lines 4A in FIGS. 2 and 3.
Figure 4B:
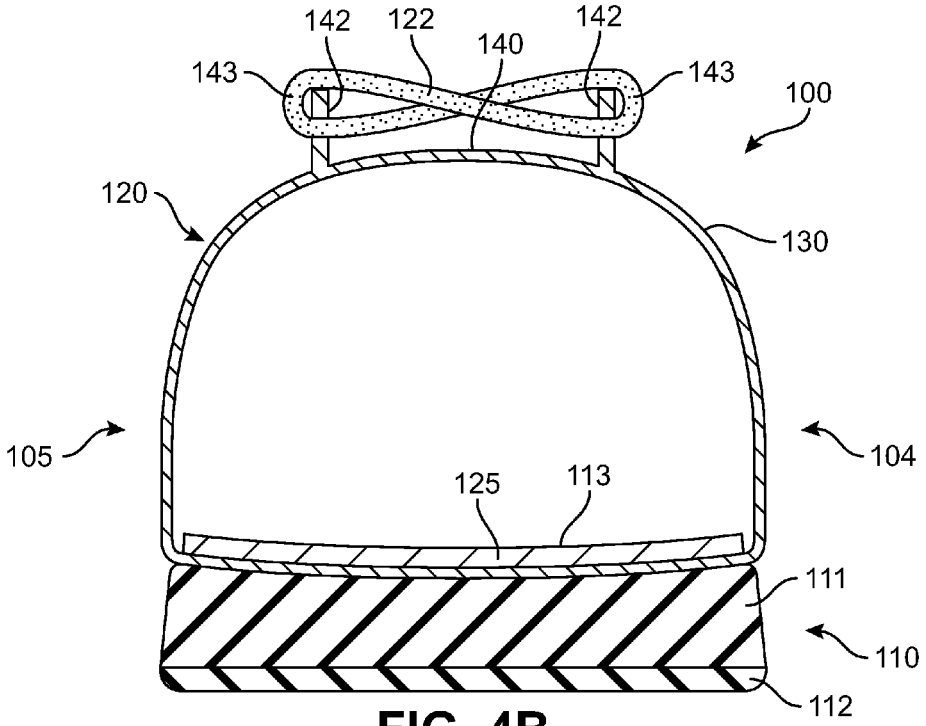
FIG. 4B is a cross-sectional view of the article of footwear, as defined by section lines 4B in FIGS. 2 and 3.

Many conventional footwear uppers are formed from multiple material elements (e.g., textiles, polymer foam, polymer sheets, leather, synthetic leather) that are joined through stitching or bonding, for example. In contrast, a majority of upper 120 is formed from a knitted component 130, which extends through each of forefoot region 101, midfoot region 102, and heel region 103, along both lateral side 104 and medial side 105, over forefoot region 101, and around heel region 103. In addition, knitted component 130 forms portions of both an exterior surface and an opposite interior surface of upper 120. As such, knitted component 130 defines at least a portion of the void within upper 120. In some configurations, knitted component 130 may also extend under the foot. Referring to FIGS. 4A and 4B, however, a strobel sock 125 is secured to knitted component 130 and an upper surface of midsole 111, thereby forming a portion of upper 120 that extends under sockliner 113.

In some embodiments, knitted component 130 may include upper 120 and integral knit tongue 140 formed of unitary knit construction. Knitted components that include upper 120 and integral knit tongue 140 may be formed with a relatively smaller number of material elements. As discussed in the Background section above, decreasing the number of material elements used in forming an upper may decrease waste, while also increasing the manufacturing efficiency and recyclability of the upper. The tongue and other portions, such as the collar, of conventional uppers are often formed from multiple separate material elements that are later joined together. As discussed in greater detail below, however, integral knit tongue element may be primarily formed through knitting processes (rather than stitch and turn methods) that decrease waste and increase manufacturing efficiency and recyclability. Additionally, the structure of integral knit tongue element 140 may incorporate smaller numbers of seams or other discontinuities, thereby enhancing the overall comfort of footwear 100.

Additional advantages of constructing integral knit tongue 140 during the knitting process and of unitary knit construction with upper 120 include providing more efficient manufacture and common properties. More particularly, manufacturing efficiency may be increased by forming more of knitted component 130 during the knitting process and eliminating various steps (e.g., making a separate tongue, securing the tongue) that are often performed manually. Integral knit tongue 140 and upper 120 may also have common properties when formed from the same yarn (or type of yarn) or with similar knit structures. For example, using the same yarn in both of integral knit tongue 140 and upper 120 imparts similar durability, strength, stretch, wear-resistance, biodegradability, thermal, and hydrophobic properties. In addition to physical properties, using the same yarn in both of integral knit tongue 140 and upper 120 may impart common aesthetic or tactile properties, such as color, sheen, and texture. Using the same knit structures in both of integral knit tongue 140 and upper 120 may also impart common physical properties and aesthetic properties. These advantages may also be present when at least a portion of integral knit tongue 140 and at least a portion of upper 120 are formed from a common yarn (or type of yarn) or with common knit structures.

Knitted Component Configurations

FIGS. 5 through 15 illustrate various embodiments of knitted components that may be incorporated into articles of footwear in a similar manner as the exemplary embodiment of FIGS. 1 through 4B. The knitted components illustrated in FIGS. 5 through 15 are depicted separate from a remainder of footwear 100. However, it should be understood that each of the embodiments of knitted components described herein may be combined with the elements of footwear 100, described above, to form an article of footwear incorporating the knitted component.

Figure 5:
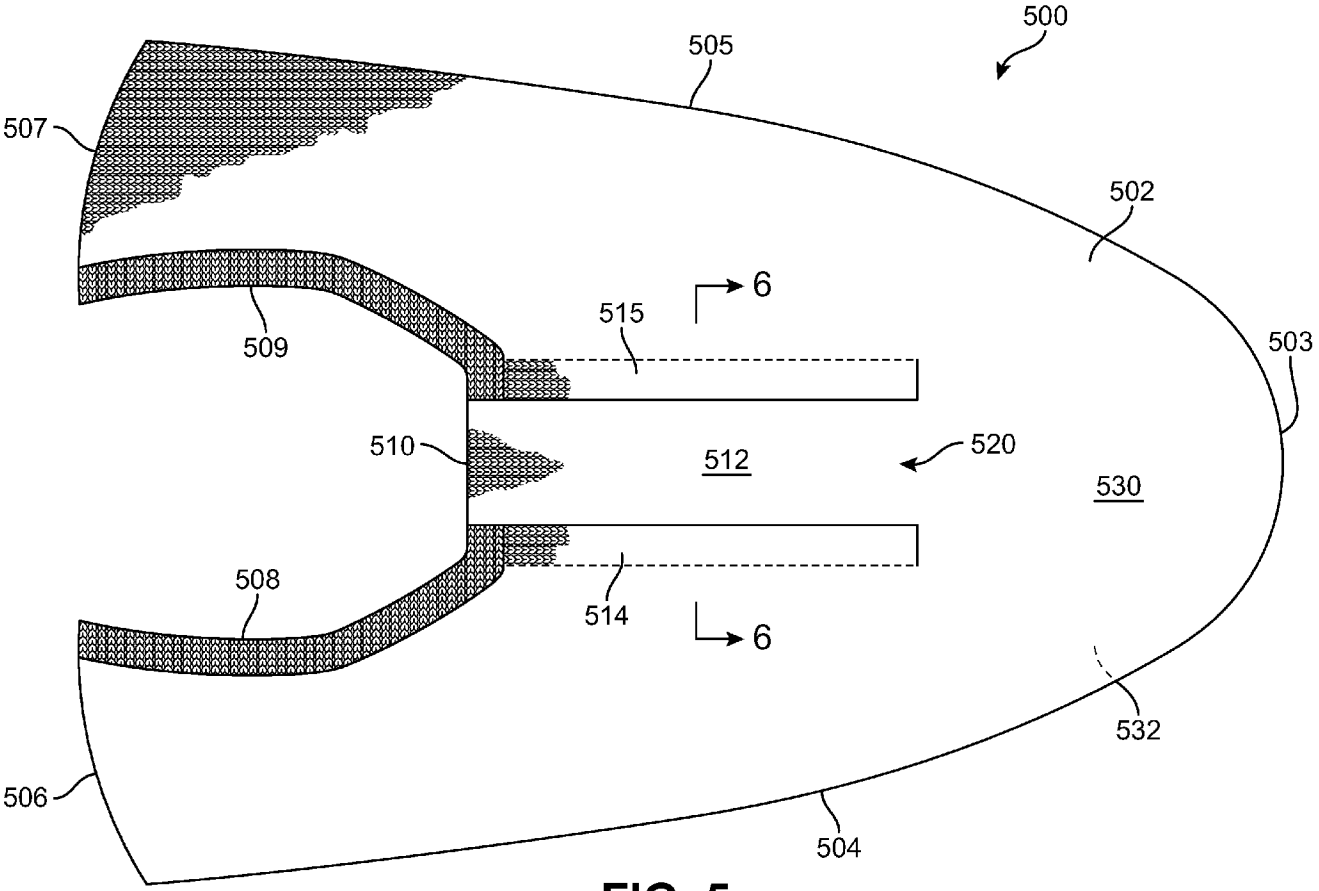
FIG. 5 is a top plan view of an exemplary embodiment of a knitted component with an integral knit tongue.

Referring now to FIG. 5, an exemplary embodiment of a first knitted component 500 is shown in a top plan view. First knitted component 500 may be substantially similar to knitted component 130, described above. In some embodiments, first knitted component 500 includes a first portion defining an upper 502 and a second portion defining an integral knit tongue 512. In an exemplary embodiment, first knitted component 500 incorporates upper 502 and integral knit tongue element 512 formed of unitary knit construction. As used herein and in the claims, a knitted component (e.g., first knitted component 500, or other knitted components described herein) is defined as being formed of "unitary knit construction" when formed as a one-piece element through a knitting process. That is, the knitting process substantially forms the various features and structures of first knitted component 500 without the need for significant additional manufacturing steps or processes. A unitary knit construction may be used to form a knitted component having structures or elements (including upper 502 and integral knit tongue 512) that include one or more courses of yarn or other knit material that are joined such that the structures or elements include at least one course in common (i.e., sharing a common yarn) and/or include courses that are substantially continuous between each of the structures or elements. With this arrangement, a one-piece element of unitary knit construction is provided.

Although portions of first knitted component 500 may be joined to each other (e.g., edges of first knitted component 500 being joined together) following the knitting process, first knitted component 500 remains formed of unitary knit construction because it is formed as a one-piece knit element. Moreover, first knitted component 500 remains formed of unitary knit construction when other elements (e.g., a lace, logos, trademarks, placards with care instructions and material information, structural elements) are added following the knitting process.

In an exemplary embodiment, the primary element of first knitted component 500 is a knit element forming upper 502 and integral knit tongue 512. A knit element may be formed from at least one yarn that is manipulated (e.g., with a knitting machine) to form a plurality of intermeshed loops that define a variety of courses and wales. That is, the knit element forming first knitted component 500 has the structure of a knit textile. Other embodiments of knitted components, including the embodiments described below, may include a knit element and at least one tensile element.

First knitted component 500 has a generally U-shaped configuration that is outlined by an outer perimeter and an inner perimeter. In this embodiment, the outer perimeter includes a front perimeter edge 503, a lateral perimeter edge 504, a medial perimeter edge 505, and a pair of heel edges, including a lateral heel edge 506 and a medial heel edge 507. The inner perimeter of first knitted component 500 includes a lateral inner edge 508, a medial inner edge 509, and a front inner edge 510. When incorporated into an article of footwear, including footwear 100, front perimeter edge 503, lateral perimeter edge 504, medial perimeter edge 505, and at least a portion of lateral heel edge 506 and medial heel edge 507 lays against an upper surface of a midsole and is joined to a strobel sock (e.g., midsole 111 and strobel sock 125, described above). In addition, lateral heel edge 506 and medial heel edge 507 are joined to each other and extend vertically in a heel region. In some configurations of footwear, a material element may cover a seam between lateral heel edge 506 and medial heel edge 507 to reinforce the seam and enhance the aesthetic appeal of the footwear. Taken together, lateral inner edge 508, medial inner edge 509, and front inner edge 510 form an ankle opening, including ankle opening 121 described above, and extends forward to a throat area 520 where integral knit tongue 512 is located. Additionally, in some embodiments, throat area 520 may further include a lace and lace apertures for receiving the lace.

In addition, first knitted component 500 may have a first surface 530 and an opposite second surface 532. First surface 530 forms a portion of the exterior surface of upper 502, whereas second surface 532 forms a portion of the interior surface of upper 502, thereby defining at least a portion of the void within upper 502.

In various embodiments, a knitted component may incorporate various types of yarn that impart different properties to separate areas of the upper. For example, one area of first knitted component 500 may be formed from a first type of yarn that imparts a first set of properties, and another area of first knitted component 500 may be formed from a second type of yarn that imparts a second set of properties. In this configuration, properties may vary throughout upper 502 by selecting specific yarns for different areas of first knitted component 500.

The properties that a particular type of yarn will impart to an area of a knitted component partially depend upon the materials that form the various filaments and fibers within the yarn. Cotton, for example, provides a soft hand, natural aesthetics, and biodegradability. Elastane and stretch polyester each provide substantial stretch and recovery, with stretch polyester also providing recyclability. Rayon provides high luster and moisture absorption. Wool also provides high moisture absorption, in addition to insulating properties and biodegradability. Nylon is a durable and abrasion-resistant material with relatively high strength. Polyester is a hydrophobic material that also provides relatively high durability.

In addition to materials, other aspects of the yarns selected for a knitted component may affect the properties of the upper. For example, a yarn forming first knitted component 500 may be a monofilament yarn or a multifilament yarn. The yarn may also include separate filaments that are each formed of different materials. In addition, the yarn may include filaments that are each formed of two or more different materials, such as a bi-component yarn with filaments having a sheath-core configuration or two halves formed of different materials. Different degrees of twist and crimping, as well as different deniers, may also affect the properties of upper 502. Accordingly, both the materials forming the yarn and other aspects of the yarn may be selected to impart a variety of properties to separate areas of upper 502.

In some embodiments, integral knit tongue 512 may be centrally-located in throat area 520 of first knitted component 500 and may extend from an ankle opening in a heel region over an area corresponding to an instep of the foot to an area adjacent to a forefoot region, as well as extending between a lateral side and a medial side of first knitted component. In an exemplary embodiment, integral knit tongue 512 is formed of unitary knit construction with upper 502 at a forward portion of throat area 520 of first knitted component 500. That is, integral knit tongue 512 is joined through knitting to upper 502 at the forward portion of throat area 520 such that integral knit tongue 512 and upper 502 include at least one course in common and/or include courses that are substantially continuous between integral knit tongue 512 and upper 502 at the forward portion of throat area 520.

In an exemplary embodiment, integral knit tongue 512 may be further formed of unitary knit construction with upper 502 along the sides of integral knit tongue 512 extending along a length of throat area 520 of first knitted component 500. Accordingly, integral knit tongue 512 is joined through knitting to upper 502 along each of a lateral side and a medial side of throat area 520 such that integral knit tongue 512 and upper 502 include at least one course in common and/or include courses that are substantially continuous between integral knit tongue 512 and upper 502 along the sides extending through throat area 520.

In some embodiments, integral knit tongue 512 may include raised elements disposed on opposite sides of throat area 520 and extending along the length of integral knit tongue 512. Raised elements may be a portion of integral knit tongue 512 that are formed through the knitting process to be a flap or overhanging portion of integral knit tongue 512 that extends outward away from first surface 530 of upper 502. As shown in FIG. 5, integral knit tongue 512 includes a lateral raised element 514 and a medial raised element 515. In an exemplary embodiment, lateral raised element 514 and medial raised element 515 are formed of unitary knit construction with integral knit tongue 512 and upper 502 according to the method below. With this arrangement, lateral raised element 514 and medial raised element 515 include one or more common courses and/or courses that are substantially continuous with integral knit tongue 512 and upper 502.

In some embodiments, raised elements associated with an integral knit tongue, including lateral raised element 514 and medial raised element 515 associated with integral knit tongue 512, may include one or more lace apertures disposed at various locations along the raised element for receiving a lace. In some cases, the lace apertures may be a void or opening within the knitted structure forming the raised element that is sufficient to allow a lace to pass through. In other cases, the lace apertures may be a hole or opening that is cut or removed from the material forming the raised elements. In still other cases, the lace apertures may include additional elements, including, but not limited to loops, grommets, eyelets, eye hooks, or other suitable lace receiving members.

Figure 6:
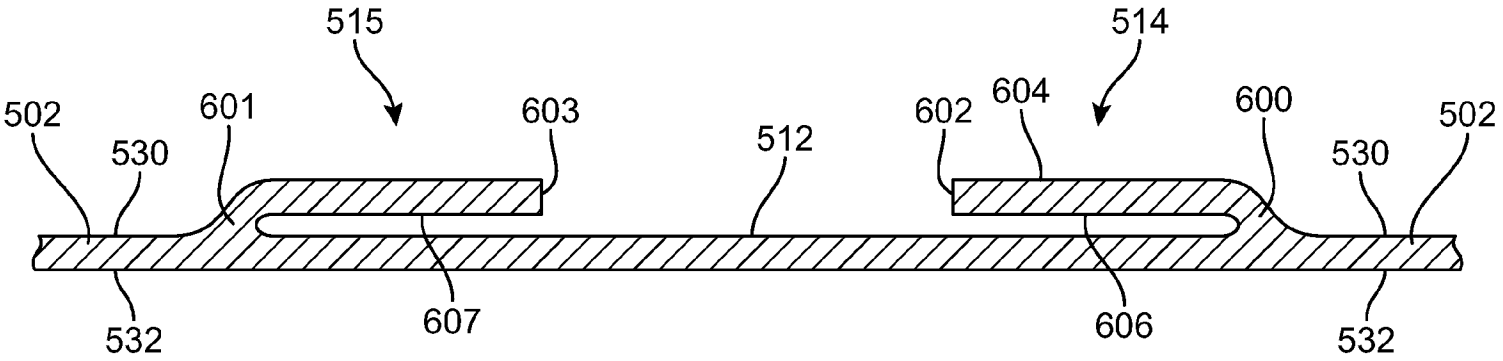
FIG. 6 is a cross-sectional view of the knitted component with the integral knit tongue, as defined by section line 6 in FIG. 5.

Referring now to FIG. 6, a cross-sectional view of integral knit tongue 512 is illustrated. In an exemplary embodiment, raised elements are formed of unitary knit construction with integral knit tongue 512 and upper 502 such that first knitted component 500 is a one-piece element. In this embodiment, lateral raised element 514 is joined with upper 502 at a first proximal end 600 and medial raised element 515 is joined with upper 502 at a second proximal end 601. Each raised element extends outward from first surface 530 of upper 502 in a flap-like arrangement to form an overhanging portion of integral knit tongue 512. In this embodiment, lateral raised element 514 extends outward from first proximal end 600 to a first distal end 602 and includes a first outward facing side 604 and a first inward facing side 606. Similarly, medial raised element 515 extends outward from second proximal end 601 to a second distal end 603 and includes a second outward facing side 605 and a second inward facing side 607. In an exemplary embodiment, first outward facing side 604 and/or second outward facing side 605 may be oriented towards each side of first knitted component 500, while first inward facing side 606 and/or second inward facing side 607 may be oriented towards the center of first knitted component 500 where integral knit tongue 512 is located.

Figure 7:
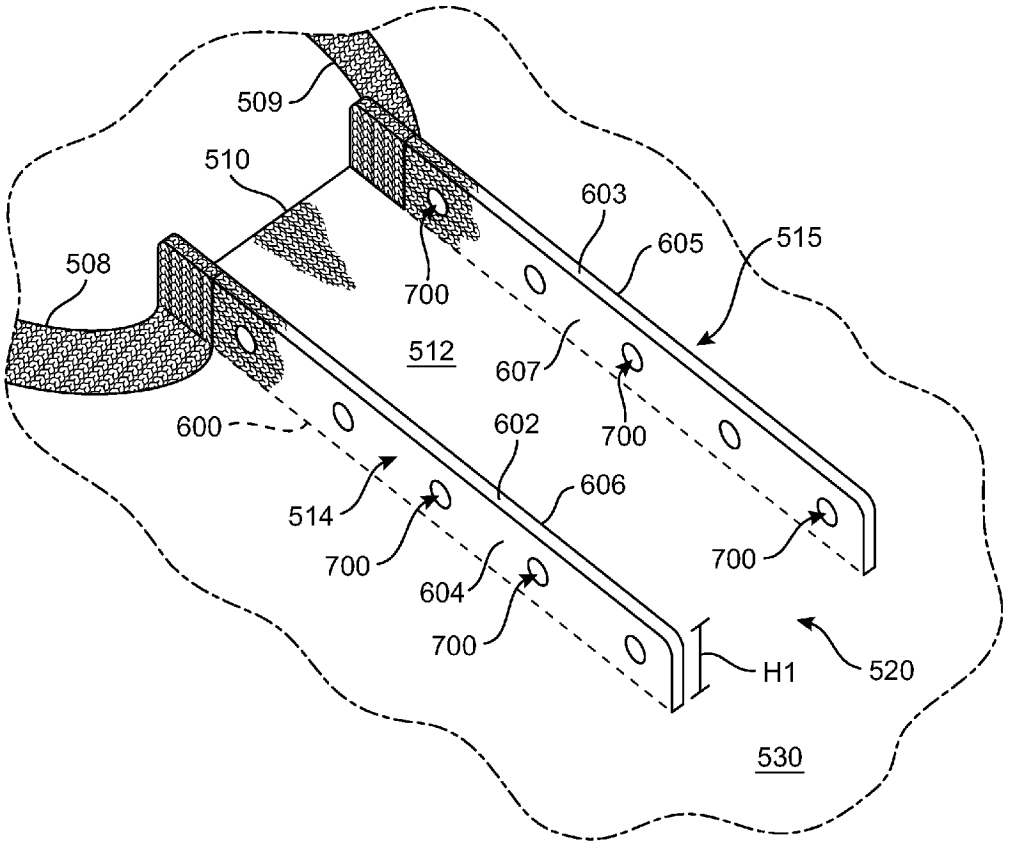
FIG. 7 is an enlarged schematic view of the integral knit tongue of the knitted component.

In addition, as shown in FIG. 6, lateral raised element 514 and medial raised element 515 are shown in a flat configuration such that first inward facing side 606 and/or second inward facing side 607 is oriented towards first surface 530. In various embodiments, however, raised elements, including lateral raised element 514 and medial raised element 515, may be positioned in an upright configuration. Referring now to FIG. 7, lateral raised element 514 and medial raised element 515 are shown in an upright configuration such that first inward facing side 606 and/or second inward facing side 607 is oriented generally perpendicular to or at a raised angle with regard to first surface 530. In some embodiments, the process of pulling upper 502 tight on opposite sides of integral knit tongue 512 (for example, by joining first knitted component 500 with a sole structure to form an article of footwear) may cause each of lateral raised element 514 and medial raised element 515 to move from the flat configuration to the upright configuration.

In an exemplary embodiment, lateral raised element 514 and medial raised element 515 of integral knit tongue 512 may extend a first height H1 above first surface 530 of first knitted component 500. In some embodiments, upright configuration of lateral raised element 514 and medial raised element 515 may be used to incorporate lace apertures into integral knit tongue 512. In this embodiment, a plurality of lace apertures 700 are shown disposed along the respective sides of lateral raised element 514 and medial raised element 515 and extending through from first outward facing side 604 to first inward facing side 606 and from second outward facing side 605 to second inward facing side 607. In some cases, plurality of lace apertures 700 may be a void or opening within the knitted structure of integral knit tongue 512 forming the raised elements. In other cases, plurality of lace apertures 700 may have a different structure, including any of the suitable structures for lace apertures described above.

Figure 8:
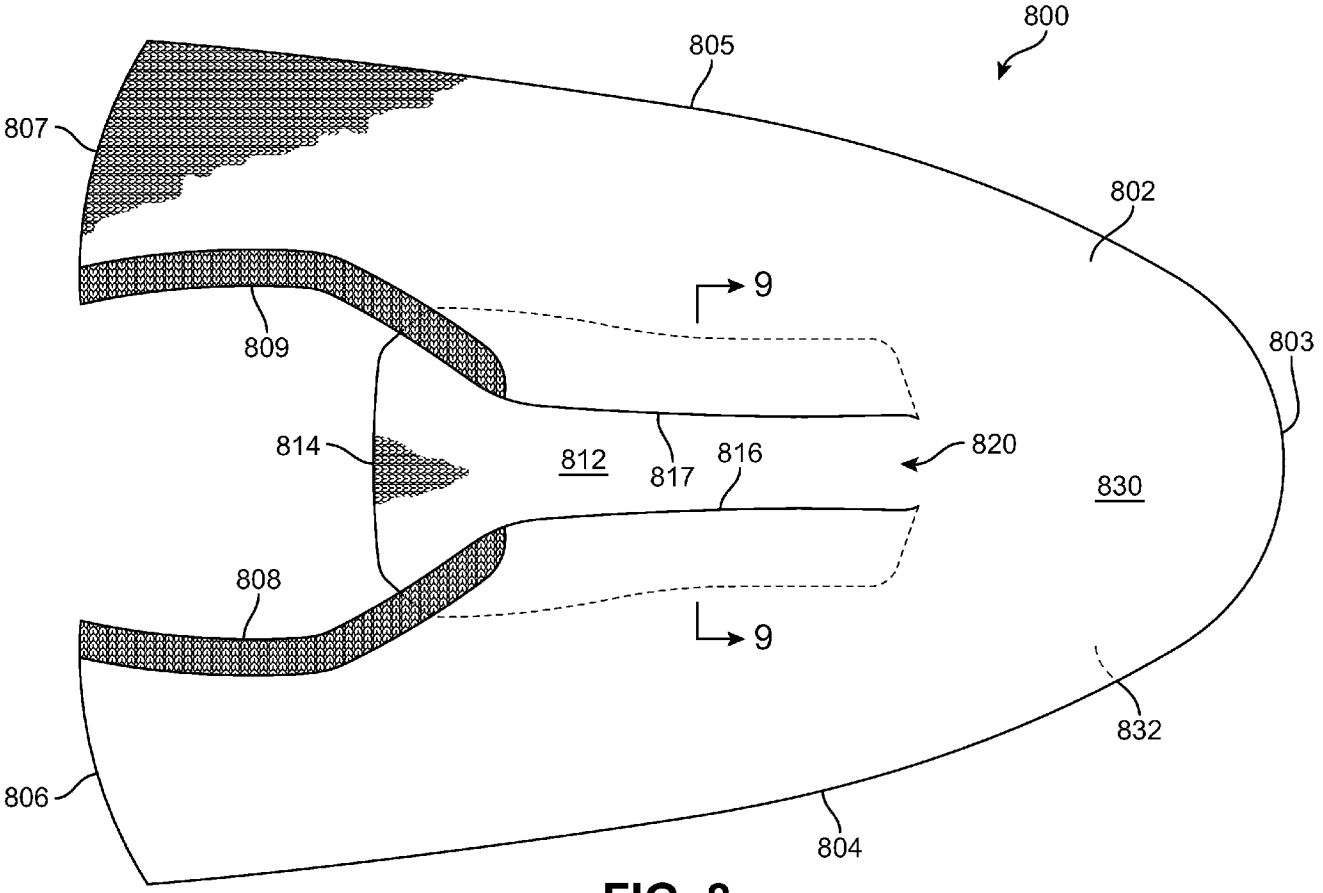
FIG. 8 is a top plan view of an alternate embodiment of a knitted component with an integral knit tongue.
Figure 9:
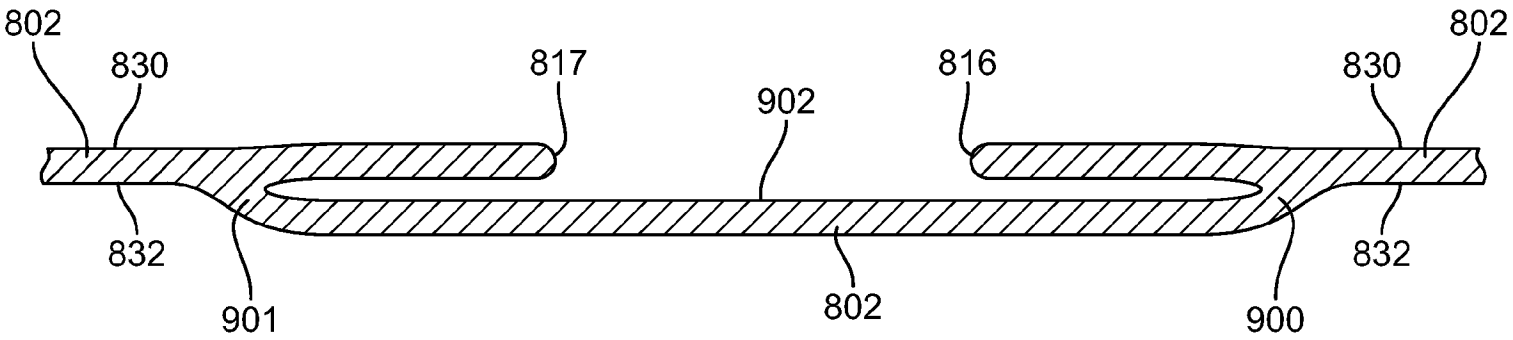
FIG. 9 is a cross-sectional view of the knitted component with the integral knit tongue, as defined by section line 9 in FIG. 8.

Referring to FIGS. 8 and 9, an exemplary embodiment of a second knitted component 800 is shown in a top plan view. Second knitted component 800 may be substantially similar to knitted component 130 and/or first knitted component 500, described above. In some embodiments, second knitted component 800 includes a first portion defining an upper 802 and a second portion defining an integral knit tongue 812. In an exemplary embodiment, second knitted component 800 incorporates upper 802 and integral knit tongue 812 formed of unitary knit construction.

As with first knitted component 500, second knitted component 800 has a generally U-shaped configuration that is outlined by an outer perimeter and an inner perimeter. In this embodiment, the outer perimeter includes a front perimeter edge 803, a lateral perimeter edge 804, a medial perimeter edge 805, and a pair of heel edges, including a lateral heel edge 806 and a medial heel edge 807. The inner perimeter of second knitted component 800 includes a lateral inner edge 808 and a medial inner edge 809 which may form an ankle opening. In addition, second knitted component 800 may have a first surface 830 forming a portion of the exterior surface of upper 802 and an opposite second surface 832 forming a portion of the interior surface of upper 802.

In an exemplary embodiment, second knitted component 800 may include integral knit tongue 812 that includes a top end 814 that extends into the portion of second knitted component 800 that is associated with an ankle opening. Top end 814 may be generally free from other portions of second knitted component 800. Integral knit tongue 812 may be formed of unitary knit construction with upper 802 at a forward portion of a throat area 820 of second knitted component 800 and along the sides of integral knit tongue 812 extending along a length of throat area 820. In an exemplary embodiment, integral tongue 812 of second knitted component 800 does not include raised elements. Accordingly, in contrast with first knitted component 500, second knitted component 800 includes a portion of upper 802 that extends over integral knit tongue 812 to form a lateral inner edge 816 and a medial inner edge 817. More particularly, edges of integral knit tongue 812 are knit to an area of second knitted component 800 that is spaced outward from lateral inner edge 816 and medial inner edge 817.

Referring now to FIG. 9, a cross-sectional view of integral knit tongue 812 is illustrated. In an exemplary embodiment, edges of integral knit tongue 812 are formed of unitary knit construction with upper 802 such that second knitted component 800 is a one-piece element. In this embodiment, first edge 900 and second edge 902 of integral knit tongue 812 are joined with second surface 832 of upper 802 such that integral knit tongue 812 extends below lateral inner edge 816 and medial inner edge 817 of upper 802. With this arrangement, a top surface of integral knit tongue 812 may be oriented facing towards second surface 832 of second knitted component 800 disposed on the portion of upper 802 extending out to lateral inner edge 816 and medial inner edge 817. In an exemplary embodiment, the configuration of integral knit tongue 812 included in second knitted component 800 may be provided to lay in a substantially flat condition.

In various embodiments, provisions may be made within a knitted component to assist a wearer with inserting and/or removing a foot from an ankle opening of an article of footwear. In some embodiments, an integral knit tongue of a knitted component may be modified to allow for a larger ankle opening. FIGS. 10 through 15 illustrate alternate embodiments of knitted components that have been provided with mechanisms to allow a larger ankle opening when incorporated into an article of footwear.

Figure 10:
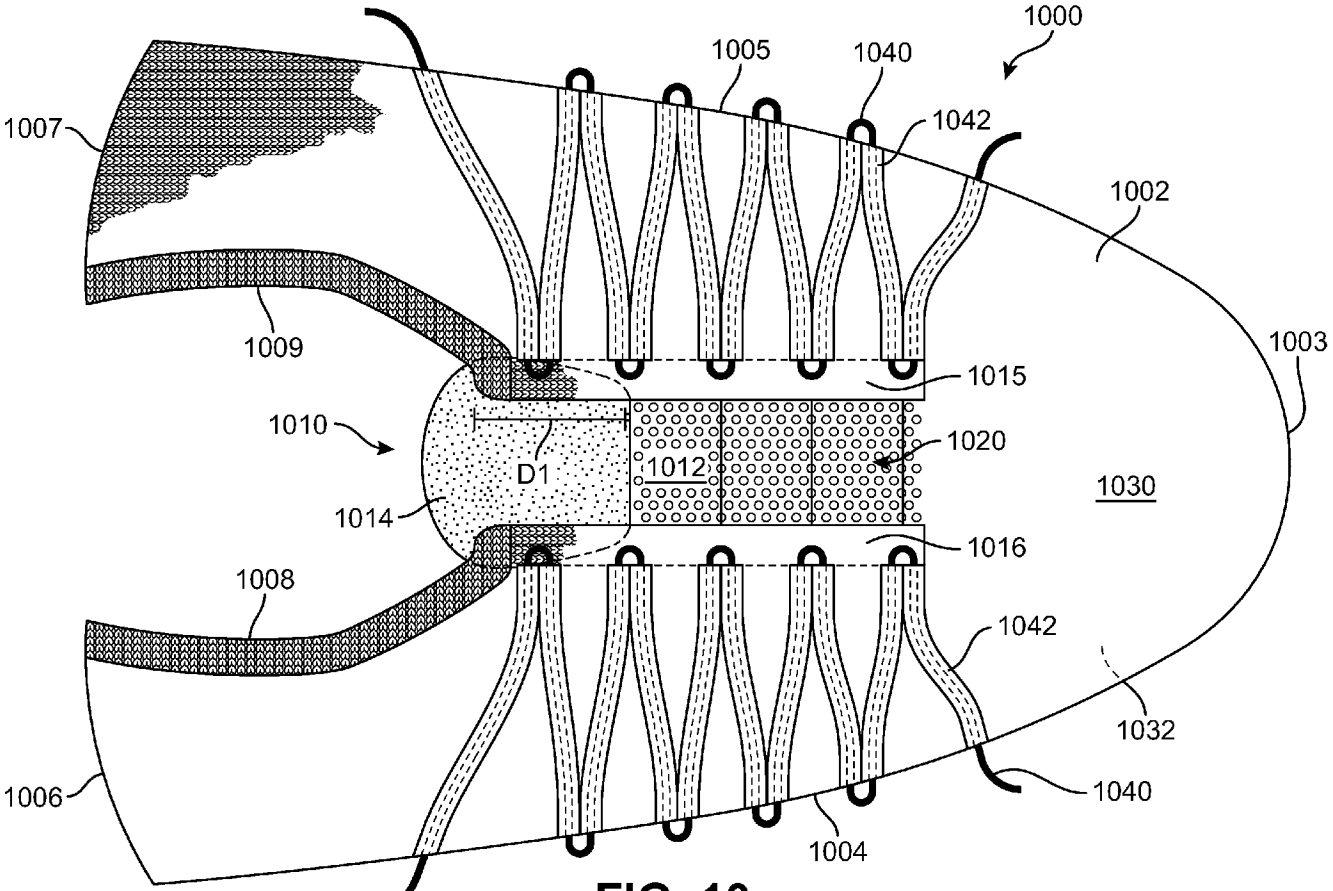
FIG. 10 is a top plan view of an alternate embodiment of a knitted component with an integral knit tongue having a partially integral portion.
Figure 11:
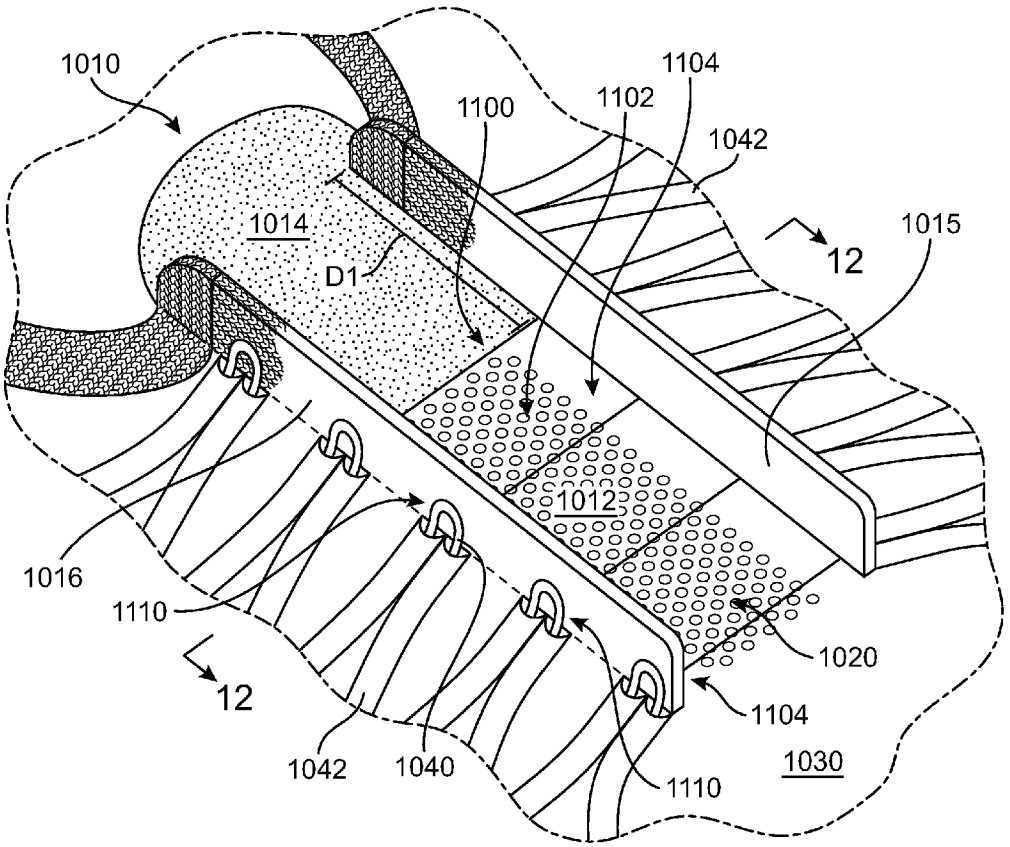
FIG. 11 is an enlarged schematic view of the integral knit tongue of the knitted component having a partially integral portion.
Figure 12:
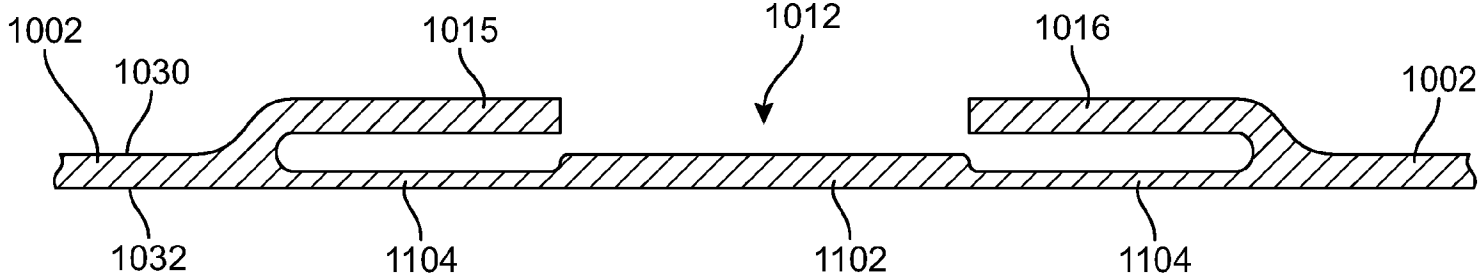
FIG. 12 is a cross-sectional view of the knitted component with the integral knit tongue having a partially integral portion, as defined by section line 12 in FIG. 11.

FIGS. 10 through 12 illustrate an alternate embodiment of a knitted component that includes a mechanism to allow a larger ankle opening when incorporated into an article of footwear. Referring now to FIG. 10, a top plan view of an alternate embodiment of a knitted component with an integral knit tongue having a partially integral portion is illustrated. In some embodiments, a third knitted component 1000 may include a first portion defining an upper 1002 and a second portion defining an integral knit tongue 1010. Third knitted component 1000 may be substantially similar to knitted component 130, first knitted component 500, and/or second knitted component 800, described above. As with first knitted component 500 and/or second knitted component 800, third knitted component 1000 may have a generally U-shaped configuration that is outlined by an outer perimeter and an inner perimeter. In this embodiment, the outer perimeter includes a front perimeter edge 1003, a lateral perimeter edge 1004, a medial perimeter edge 1005, and a pair of heel edges, including a lateral heel edge 1006 and a medial heel edge 1007. The inner perimeter of third knitted component 1000 includes a lateral inner edge 1008 and a medial inner edge 1009 which may form an ankle opening. In addition, third knitted component 1000 may have a first surface 1030 forming a portion of the exterior surface of upper 1002 and an opposite second surface 1032 forming a portion of the interior surface of upper 1002.

In some embodiments, third knitted component 1000 may further include additional structures. In an exemplary embodiment, third knitted component 1000 may include at least one tensile element 1040 that is inlaid within the knit structure of third knitted component 1000. Suitable materials for tensile element 1040 may include, but is not limited to, yarn or an inlaid strand in the configuration of a filament (e.g., a monofilament), thread, rope, webbing, cable, or chain. Tensile element 1040 extends through third knitted component 1000 and passes between the various loops within a knit structure 1042 formed within third knitted component 1000. Although tensile element 1040 generally extends along courses within knit structure 1042, tensile element 1040 may also extend along wales within knit structure 1042. Advantages of tensile element 1040 include providing support, stability, and structure. For example, tensile element 1040 assists with securing upper 1002 around the foot, limits deformation in areas of upper 1002 (e.g., imparts stretch-resistance) and operates in connection with a lace to enhance the fit of the article of footwear incorporating third knitted component.

A tensile element in the form of an inlaid strand or other suitable element, as well as the method of manufacturing a knitted component incorporating an inlaid strand and knit structures, for use in the embodiments described herein is disclosed in one or more of commonly-owned U.S. patent application Ser. No. 12/338,726 to Dua et al., entitled "Article of Footwear Having An Upper Incorporating A Knitted Component", filed on Dec. 18, 2008 and published as U.S. Patent Application Publication Number 2010/0154256 on Jun. 24, 2010, and U.S. patent application Ser. No. 13/048,514 to Huffa et al., entitled "Article Of Footwear Incorporating A Knitted Component", filed on Mar. 15, 2011 and published as U.S. Patent Application Publication Number 2012/0233882 on Sep. 20, 2012, both of which applications are hereby incorporated by reference in their entirety (collectively referred to herein as the "Inlaid Strand cases").

In an exemplary embodiment, third knitted component 1000 incorporates upper 1002 and integral knit tongue 1010 formed of unitary knit construction such that at least a portion of upper 1002 and a portion of integral knit tongue 1010 are a one-piece element. In one embodiment, integral knit tongue 1010 may further include a first portion that is formed of unitary knit construction with upper 1002 along the sides of integral knit tongue 1010 and a second portion that is formed of unitary knit construction with the first portion, but is otherwise free from upper 1002. In this embodiment, third knitted component 1000 includes integral knit tongue 1010 having a partially integral portion 1012 and a free portion 1014.

In an exemplary embodiment, partially integral portion 1012 may be centrally-located in a throat area 1020 of third knitted component 1000 and may extend from a distance D1 adjacent to an ankle opening in a heel region over an area corresponding to an instep of the foot to an area adjacent to a forefoot region, as well as extending between a lateral side and a medial side of third knitted component 1000. In one embodiment, partially integral portion 1012 is formed of unitary knit construction with upper 1002 at a forward portion of throat area 1020 as well as along the sides extending along a length of throat area 1020 of third knitted component 1000. Accordingly, partially integral portion 1012 is joined through knitting to upper 1002 along the forward portion and each of a lateral side and a medial side of throat area 1020 such that partially integral portion 1012 and upper 1002 include at least one course in common and/or include courses that are substantially continuous.

In an exemplary embodiment, integral knit tongue 1010 may include raised elements disposed on opposite sides of throat area 1020 and extending along the length of integral knit tongue 1010. Raised elements may be a portion of integral knit tongue 1010 that are formed through the knitting process to be a flap or overhanging portion of integral knit tongue 1010 that extends outward away from first surface 1030 of upper 1002. As shown in FIGS. 10 and 11, integral knit tongue 1010 includes a lateral raised element 1016 and a medial raised element 1015 that are formed of unitary knit construction with upper 1002 and partially integral portion 1012 of integral knit tongue 1010. Lateral raised element 1016 and/or medial raised element 1015 may be substantially similar to, and similarly formed as lateral raised element 514 and medial raised element 515, described above.

Referring now to FIG. 11, in an exemplary embodiment, free portion 1014 may be disposed at a top end of throat area 1020 of third knitted component 1000 adjacent to the ankle opening. In one embodiment, free portion 1014 is formed of a unitary knit construction with partially integral portion 1012 at a rearward portion 1100 of throat area 1020, but is otherwise not joined or attached to other portions of upper 1002 and/or third knitted component 1000. With this arrangement, an ankle opening may be provided with a larger opening corresponding to the location of rearward portion 1100 of partially integral portion 1012 of integral knit tongue 1010 that extends distance D1 from the ankle opening along throat area 1020 of third knitted component 1000. Free portion 1014 of integral knit tongue 1010 may serve to cover a foot of a wearer disposed within the ankle opening to enhance the comfort of the article of footwear incorporating third knitted component 1000.

In some embodiments, partially integral portion 1012 of integral knit tongue 1010 may include multiple knit structures, including knit structures of different types. For example, partially integral portion 1012 may include a first knit structure 1102 and a second knit structure 1104. First knit structure 1102 may be associated with a first knit type and may be centrally located and extending along integral knit tongue 1010 from rearward portion 1100 to the forward portion of throat area 1020. Second knit structure 1104 may be associated with a second knit type and may be located along peripheral sides of integral knit tongue 1010 between first knit structure 1102 and each of lateral raised element 1016 and medial raised element 1015 extending similarly from rearward portion 1100 to the forward portion of throat area 1020. In one embodiment, first knit structure 1102 and second knit structure 1104 may be different knit structures or different types of knit structures. For example, in some cases, first knit structure 1102 may be a mesh or similar knit type and second knit structure 1104 may be a jersey or similar knit type. In other cases, first knit structure 1102 may be a double-knit jersey structure and second knit structure 1104 may be a single-knit jersey structure. As shown in FIG. 12, first knit structure 1102 may have a greater thickness than second knit structure 1104 disposed on either peripheral side of first knit structure 1102 extending along the length of partially integral portion 1012 of integral knit tongue 1010.

In some embodiments, lace apertures for receiving a lace may be provided by tensile element 1040. In an exemplary embodiment, a plurality of lace loops 1110 may be disposed at portions of tensile element 1040 that extend out from knit structure 1042 adjacent to lateral raised element 1016 and medial raised element 1015 on opposite sides of throat area 1020 of third knitted component 1000. With this configuration, a lace (not shown) may be disposed through plurality of lace loops 1110 to assist with securing an article of footwear incorporating third knitted component 1000 onto a foot of a wearer. In other embodiments, lace apertures may have a different structure, including any of the suitable structures for lace apertures described above.

Figure 13:
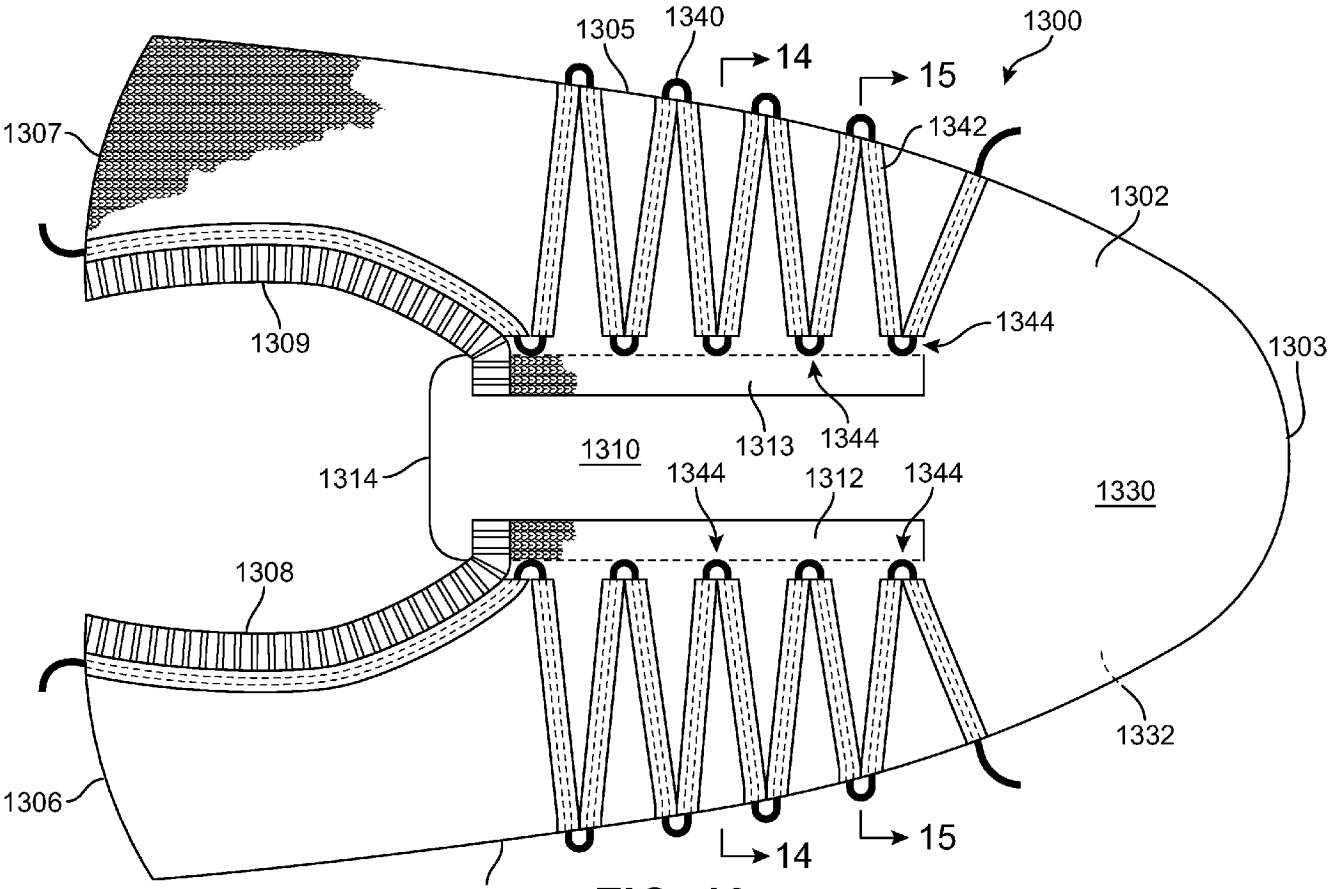
FIG. 13 is a top plan view of an alternate embodiment of a knitted component with an integral knit tongue having partially decoupled knit elements.
Figure 14:
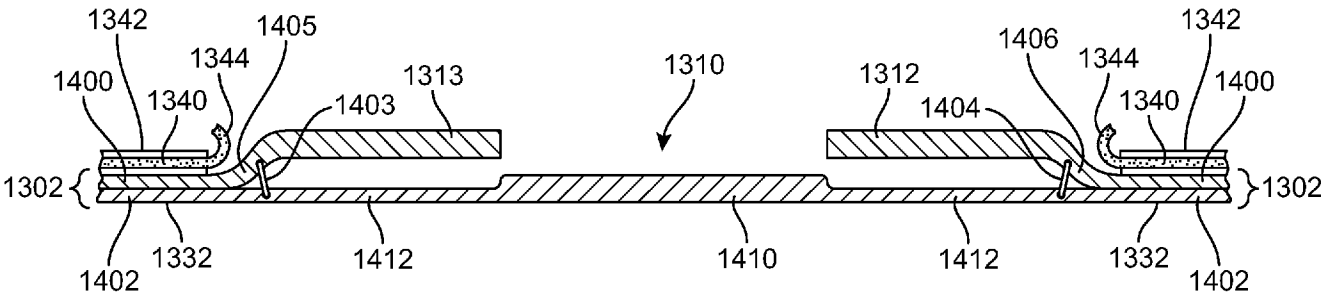
FIG. 14 is a cross-sectional view of the integral knit tongue of the knitted component having partially decoupled knit elements, as defined by section line 14 in FIG. 13.
Figure 15:
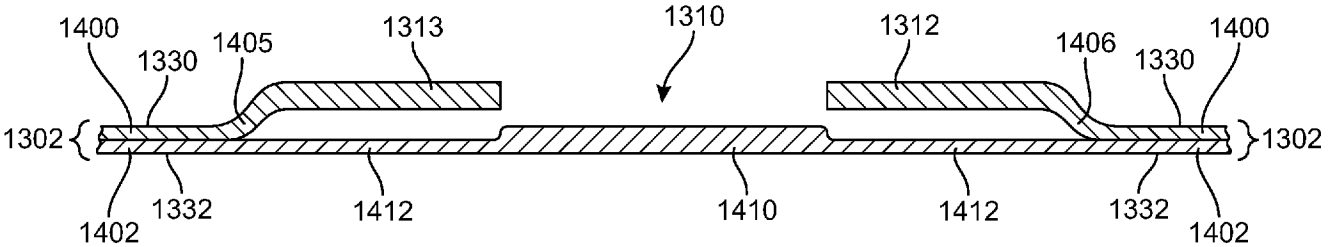
FIG. 15 is a cross-sectional view of the integral knit tongue of the knitted component having partially decoupled knit elements, as defined by section line 15 in FIG. 13.

FIGS. 13 through 15 illustrate another alternate embodiment of a knitted component with a mechanism to allow a larger ankle opening when incorporated into an article of footwear. Referring now to FIG. 13, a top plan view of an alternate embodiment of a knitted component with an integral knit tongue having partially decoupled knit elements is illustrated. In some embodiments, a fourth knitted component 1300 may include a first portion defining an upper 1302 and a second portion defining an integral knit tongue 1310. Fourth knitted component 1300 may share one or more substantially similar features with knitted component 130, first knitted component 500, second knitted component 800, and/or third knitted component 1000, described above. As with the previous embodiments of knitted components, fourth knitted component 1300 may similarly have a generally U-shaped configuration that is outlined by an outer perimeter and an inner perimeter. In this embodiment, the outer perimeter includes a front perimeter edge 1303, a lateral perimeter edge 1304, a medial perimeter edge 1305, and a pair of heel edges, including a lateral heel edge 1306 and a medial heel edge 1307. The inner perimeter of fourth knitted component 1300 includes a lateral inner edge 1308 and a medial inner edge 1309 which may form an ankle opening. In addition, fourth knitted component 1300 may have a first surface 1330 forming a portion of the exterior surface of upper 1302 and an opposite second surface 1332 forming a portion of the interior surface of upper 1302.

In some embodiments, fourth knitted component 1300 may further include additional structures, including at least one tensile element 1340 that is inlaid within a knit structure 1342 of fourth knitted component 1300. Tensile element 1340 may be substantially similar to tensile element 1040, described above, including suitable materials and methods of manufacturing a knitted component incorporating tensile elements and knit structures disclosed in the Inlaid Strand cases. In an exemplary embodiment, tensile element 1340 may further include a plurality of lace loops 1344 that may be configured to receive a lace. Plurality of lace loops 1344 may be disposed at portions of tensile element 1340 that extend out from knit structure 1342 and may have a substantially similar structure as lace loops 1110, described above. In some cases, lace loops 1344 may serve as lace apertures for receiving a lace. In other cases, lace loops 1344 may coordinate with one or more lace apertures disposed within raised elements of integral knit tongue 1310 to receive a lace. In still other cases, lace loops 1344 may be disposed through lace apertures disposed within raised elements and may receive a lace that extends through a throat area 1320 of upper 1302.

In an exemplary embodiment, fourth knitted component 1300 incorporates upper 1302 and integral knit tongue 1310 formed of unitary knit construction such that at least a portion of upper 1302 and a portion of integral knit tongue 1310 are a one-piece element. In one embodiment, portions of upper 1302 may be formed from multiple knit element layers. Accordingly, integral knit tongue 1310 may be formed of unitary knit construction with at least one of the knit element layers.

In some embodiments, integral knit tongue 1310 may be centrally-located in throat area 1320 of fourth knitted component 1300 and may extend from a top end 1314 adjacent to an ankle opening in a heel region over an area corresponding to an instep of the foot to an area adjacent to a forefoot region, as well as extending between a lateral side and a medial side of upper 1302. In an exemplary embodiment, integral knit tongue 1310 is formed of unitary knit construction with at least one knit element layer associated with upper 1302 at a forward portion of throat area 1320 and along the sides extending along a length of throat area 1320 of fourth knitted component 1300.

In an exemplary embodiment, fourth knitted component 1300 may further include raised elements disposed on opposite sides of throat area 1320 and extending along the length of integral knit tongue 1310. As shown in FIGS. 13 through 15, fourth knitted component 1300 includes a lateral raised element 1312 and a medial raised element 1313 that are formed of unitary knit construction with at least one knit element layer of upper 1302. Lateral raised element 1312 and/or medial raised element 1313 may be substantially similar to, and similarly formed as lateral raised elements 514, 1016 and/or medial raised elements 515, 1015, described above.

In some embodiments, the portion of fourth knitted component 1300 forming integral knit tongue 1310 may made from a different material than the remaining portion of fourth knitted component 1300. In an exemplary embodiment, integral knit tongue 1310 may be made from an elastic yarn that has a large degree of elasticity, while the remaining portions of fourth knitted component 1300 may be made from a regular yarn that is substantially inelastic or that has a smaller degree of elasticity compared with the elastic yarn. With this arrangement, integral knit tongue portion 1310 of fourth knitted component 1300 may be configured with throat area 1320 that is allowed to stretch to accommodate a foot of a wearer inserted through an ankle opening of an article of footwear incorporating fourth knitted component 1300.

Additionally, in some embodiments, by forming integral knit tongue 1310 of unitary knit construction with a first knit element layer of fourth knitted component 1300 that is partially decoupled from a second knit element layer, the throat area 1320 may further be permitted to stretch to allow a larger ankle opening for an article of footwear incorporating fourth knitted component 1300. The partial decoupling of the first knit element layer and the second knit element layer may be shown in FIGS. 14 and 15.

Referring now to FIGS. 14 and 15, in this embodiment, upper 1302 may include a first knit element layer 1400 associated with first surface 1330 of fourth knitted component 1300 and a second knit element layer 1402 associated with second surface 1332 of fourth knitted component 1300. In an exemplary embodiment, first knit element layer 1400 and second knit element layer 1402 may be partially decoupled at the portion of fourth knitted component 1300 associated with integral knit tongue 1310. That is, while other portions of fourth knitted component 1300 may include a single knit element having first surface 1330 on one side and second surface 1332 on the opposite side, the partially decoupled portion of fourth knitted component 1300 includes separate first knit element layer 1400 and second knit element layer 1402 disposed adjacent to one another, but not joined along the entirety of their surfaces. Accordingly, first surface 1330 is disposed on one side of first knit element layer 1400 and second surface 1332 is disposed on one side of second knit element layer 1402. At other portions of fourth knitted component 1300, first knit element layer 1400 and second knit element layer 1402 may be rejoined with one another through the knitting process so as to form a single knit element extending through the remaining portion of fourth knitted component 1300.

In an exemplary embodiment, integral knit tongue 1310 may be formed of unitary knit construction with at least one knit element layer. In one embodiment, integral knit tongue 1310 is formed of unitary knit construction with second knit element layer 1402. As shown in FIGS. 14 and 15, integral knit tongue 1310 is joined through knitting to second knit element layer 1402 of upper 1302 along each of a lateral side and a medial side of throat area 1320 such that integral knit tongue 1310 and second knit element layer 1402 include at least one course in common and/or include courses that are substantially continuous between integral knit tongue 1310 and second knit element layer 1402 along the sides of upper 1302 extending through throat area 1320. Similarly, in an exemplary embodiment, raised elements, including lateral raised element 1312 and medial raised element 1313, may be formed of unitary knit construction with first knit element layer 1400.

In some embodiments, integral knit tongue 1310 may include multiple knit structures, including knit structures of different types, as described above. For example, integral knit tongue 1310 may include a first knit structure 1410 and a second knit structure 1412. First knit structure 1410 may be associated with a first knit type and may be centrally located and extending along integral knit tongue 1310 from a rearward portion to the forward portion of throat area 1320. Second knit structure 1412 may be associated with a second knit type and may be located along peripheral sides of integral knit tongue 1310 between first knit structure 1410 and each of lateral raised element 1312 and medial raised element 1313 extending similarly from the rearward portion to the forward portion of throat area 1320. In this embodiment, first knit structure 1410 and second knit structure 1412 may be similar made of an elastic yarn, however, first knit structure 1410 may be a double-knit jersey structure and second knit structure 1412 may be a single-knit jersey structure. As shown in FIGS. 14 and 15, first knit structure 1410 may have a greater thickness than second knit structure 1412.

In some embodiments, portions of first knit element layer 1400 and second knit element layer 1402 may be joined to secure first knit element layer 1400 and second knit element layer 1402 at desired locations along integral knit tongue 1310. As shown in FIG. 14, a first yarn 1404 may be used to join first knit element layer 1400 to second knit element layer 1402 at a first end 1406 where lateral raised element 1312 begins to extend outward over integral knit tongue 1310. Similarly, a second yarn 1403 may be used to join first knit element layer 1400 to second knit element layer 1402 at a second end 1405 where medial raised element 1313 begins to extend outward over integral knit tongue 1310. In some cases, first yarn 1404 and/or second yarn 1403 may include a single yarn or a plurality of yarns from fourth knitted component 1300 that join first knit element layer 1400 to second knit element layer 1402 during the knitting process. In other cases, first yarn 1404 and/or second yarn 1403 may include a stitch or a plurality of stitches that are used to join first knit element layer 1400 to second knit element layer 1402 after the knitting process.

In one embodiment, the location of first yarn 1404 and/or second yarn 1403 may be chosen to coincide with one or more of lace loops 1344 of tensile element 1340. With this arrangement, first knit element layer 1400 and second knit element layer 1402 may be secured to each other at the location that corresponds to where a lace may be used to secure throat area 1320 of upper 1302 to fit onto a foot of a wearer of an article of footwear incorporating fourth knitted component 1300. In contrast, the partially decoupled portion of fourth knitted component 1300 shown in FIG. 15 does not include first yarn 1404 and/or second yarn 1403 joining first knit element layer 1400 to second knit element layer 1402. Accordingly, at the partially decoupled portion, first knit element layer 1400 and second knit element layer 1402 may be allowed to move independently of one another. This arrangement, together with the use of an elastic yarn to form one or more portions of second knit element layer forming integral knit tongue 1310, allows throat area 1320 to stretch to allow a larger ankle opening for an article of footwear incorporating fourth knitted component 1300.

Knitting Process for a Knitted Component

FIGS. 16 through 29 illustrate various knitting processes that may be used to manufacture a knitted component in accordance with the principles described herein. In various embodiments described herein, the different knit structures of a particular knitted component may be made using various types of knit structures, including knit types and yarn types.

In an exemplary embodiment, the integral knit tongue of a knitted component that includes raised elements along a medial side and a lateral side may be formed using a specific knitting process. For purposes of reference, FIG. 16 depicts a loop diagram of the manner in which raised elements associated with an integral knit tongue, including, for example, any of raised elements 142, raised elements 514, 515, raised elements 1015, 1016, and/or raised elements 1312, 1313 is formed with a knitting process 1600.

Figure 16:
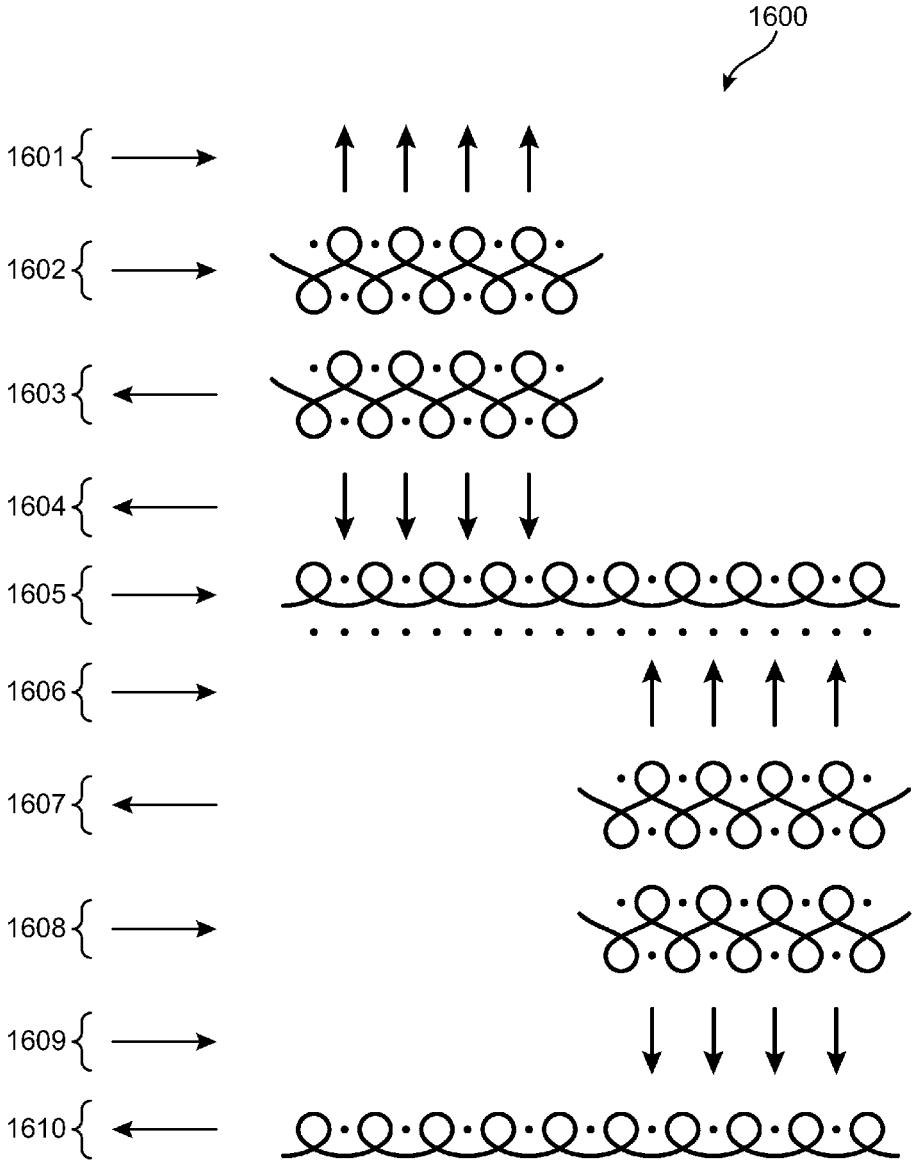
FIG. 16 is a loop diagram of an exemplary embodiment of an integral knit tongue.

As shown in FIG. 16, knitting process 1600 for an integral knit tongue having raised elements may include loop diagrams indicating the direction and type of knitting operation being performed to make the integral knit tongue. It should be understood that the remaining portion of a knitted component may be made according to any suitable knitting process, knitting process 1600 details an exemplary knitting process for an integral knit tongue portion of the overall knitted component. Accordingly, in a first step 1601, yarn is transferred to a back bed of a knitting machine. Next, in a second step 1602, the yarn is knit along a first direction as shown, then back along a second, opposite direction in a third step 1603. Next, in a fourth step 1604, the yarn is transferred to a front bed of the knitting machine and the yarn is knit along the first direction in a fifth step 1605. With this process, a raised element along one side of the integral knit tongue is formed. While an exemplary knit type is illustrated for fifth step 1605 which may form the central portion of an integral knit tongue, any suitable knit type may be used to make a central portion of the integral knit tongue having any desired knit structure.

Similarly, from fifth step 1605, a raised element disposed on the opposite side of the integral knit tongue may also be formed. As shown in FIG. 16, after completing knitting associated with fifth step 1605, the yarn may be transferred to the back bed of the knitting machine at a sixth step 1606 and the yarn is knit along the second direction as shown in a seventh step 1607, then back along in the opposite, first direction in an eighth step 1608. The yarn may then be transferred back to the front bed of the knitting machine at a ninth step 1609 and the yarn is knit along the second direction in a tenth step 1610 along the entirety of the width of the integral knit tongue. The exemplary knitting process 1600 may be repeated multiple times to make an integral knit tongue with raised elements having the desired length along the knitted component. Similarly, portions of the integral knit tongue may be made wider or narrower by changing a number of needles that are associated with knitting process 1600. For example, portions of knitting process 1600, including fifth step 1605 and/or tenth step 1610, may be varied to include a larger or smaller number of needles to correspondingly increase or decrease the width of the integral knit tongue. In addition, as noted above, other knitting processes not shown here may be used to make the remaining portions of the knitted component.

Additionally, the knit types illustrated in FIG. 16 are exemplary and in different embodiments may be varied. For example, as shown in knitting process 1600, each raised element is made from a double-jersey half-gauge knit, whereas the central portion of the integral knit tongue is made from a single-jersey half-gauge knit. However, in other embodiments, one or more knit types may vary. For example, in some cases, the central portion of the integral knit tongue may include one or more portions of full-gauge (or "all-needle") single or double-jersey knit. In other cases, the width of various knit types along the central portion of the integral tongue may be varied repeatedly, for example, by using different numbers of needles, as noted above. Still other cases may include a combination of knit types and/or knit structures employing various combinations of knit, tuck, or float stitches.

Figure 17:
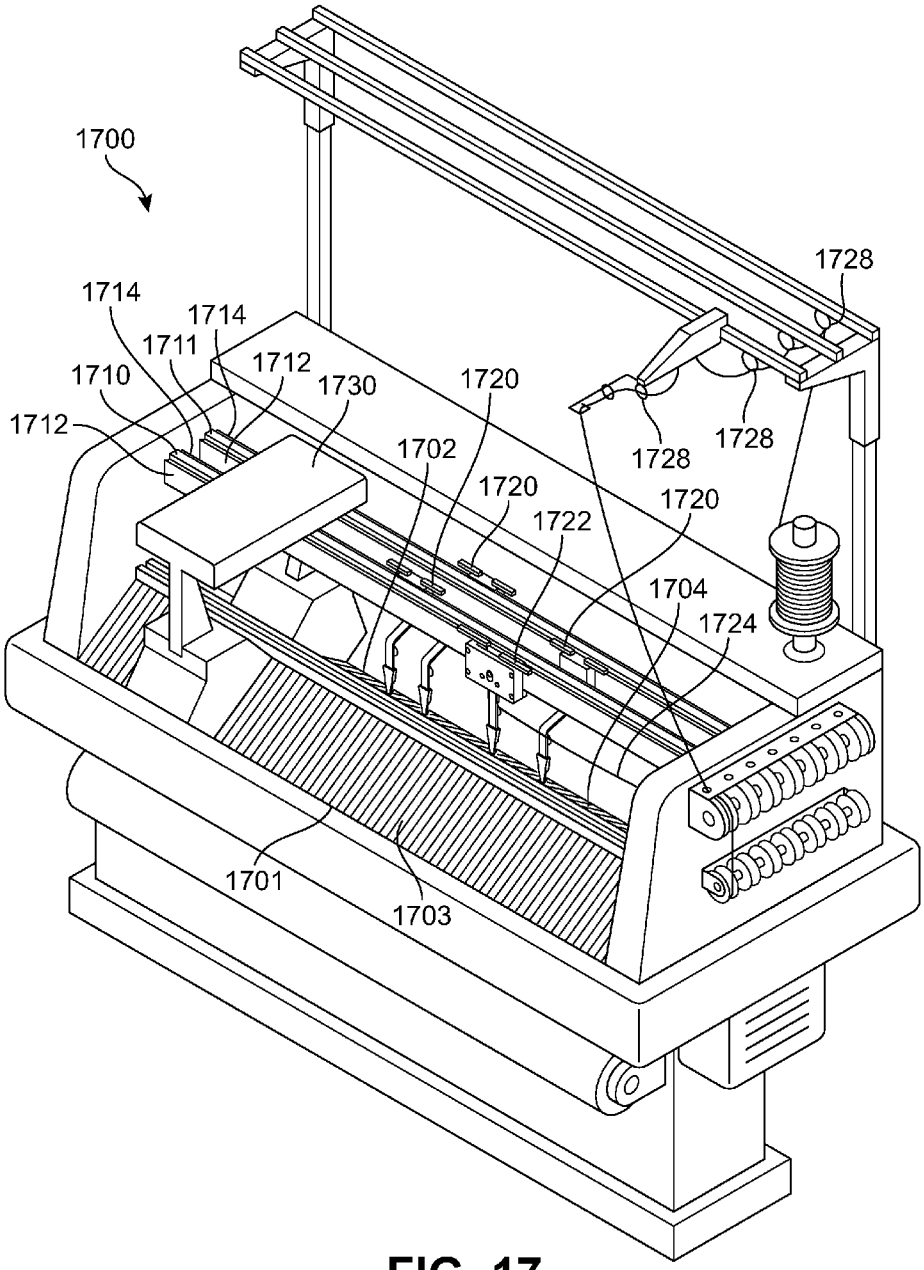
FIG. 17 is an isometric view of an exemplary embodiment of a knitting machine.

Although knitting may be performed by hand, the commercial manufacture of knitted components is generally performed by knitting machines. FIG. 17 illustrates an exemplary embodiment of a knitting machine 1700 that is suitable for producing any of the knitted components described in the previous embodiments, including knitted component 130, first knitted component 500, second knitted component 800, third knitted component 1000, and/or fourth knitted component 1300, as well as other configurations of knitted components not explicitly illustrated or described but made according to the principles described herein. In this embodiment, knitting machine 1700 has a configuration of a V-bed flat knitting machine for purposes of example, but any of the knitted components or portions of knitted components may be produced on other types of knitting machines.

In an exemplary embodiment, knitting machine 1700 may include two needle beds, including a front needle bed 1701 and a back needle bed 1702, that are angled with respect to each other, thereby forming a V-bed. Each of front needle bed 1701 and back needle bed 1702 include a plurality of individual needles that lay on a common plane, including needles 1703 associated with front bed 1701 and needles 1704 associated with back bed 1702. That is, needles 1703 from front needle bed 1701 lay on a first plane, and needles 1704 from back needle bed 1702 lay on a second plane. The first plane and the second plane (i.e., the two needle beds 1701, 1702) are angled relative to each other and meet to form an intersection that extends along a majority of a width of knitting machine 1700. As described in greater detail below, needles 1703, 1704 each have a first position where they are retracted and a second position where they are extended. In the first position, needles 1703, 1704 are spaced from the intersection where the first plane and the second plane meet. In the second position, however, needles 1703, 1704 pass through the intersection where the first plane and the second plane meet.

A pair of rails, including a forward rail 1710 and a rear rail 1711, extends above and parallel to the intersection of needle beds 1701, 1702 and provide attachment points for multiple standard feeders 1720 and combination feeders 1722. Each rail 1710, 1711 has two sides, each of which accommodates either one standard feeder 1720 or one combination feeder 1722. In this embodiment, rails 1710, 1711 include a front side 1712 and a back side 1714. As such, knitting machine 1700 may include a total of four feeders 1720 and 1722. As depicted, the forward-most rail, forward rail 1710, includes one combination feeder 1722 and one standard feeder 1720 on opposite sides, and the rearward-most rail, rear rail 1711, includes two standard feeders 1720 on opposite sides. Although two rails 1710, 1711 are depicted, further configurations of knitting machine 1700 may incorporate additional rails to provide attachment points for more standard feeders 1720 and/or combination feeders 1722.

Due to the action of a carriage 1730, feeders 1720 and 1722 move along rails 1710, 1711 and needle beds 1701, 1702, thereby supplying yarns to needles 1703, 1704. As shown in FIG. 17, a yarn 1724 is provided to combination feeder 1722 by a spool 1726. More particularly, yarn 1724 extends from spool 1726 to various yarn guides 1728, a yarn take-back spring, and a yarn tensioner before entering combination feeder 1722. Although not depicted, additional spools may be used to provide yarns to feeders 1720 in a substantially similar manner as spool 1726.

Standard feeders 1720 are conventionally-used for a V-bed flat knitting machine, such as knitting machine 1700. That is, existing knitting machines incorporate standard feeders 1720. Each standard feeder 1720 has the ability to supply a yarn that needles 1703, 1704 manipulate to knit, tuck, and float. As a comparison, combination feeder 1722 has the ability to supply a yarn (e.g., yarn 1724) that needles 1703, 1704 knit, tuck, and float, and combination feeder 1722 further has the ability to inlay the yarn. Moreover, combination feeder 1722 has the ability to inlay a variety of different tensile elements, including yarn or other types of strands (e.g., filament, thread, rope, webbing, cable, or chain). Accordingly, combination feeder 1722 exhibits greater versatility than each standard feeder 1720.

Standard feeders 1720 and combination feeder 1722 may have substantially similar configurations as the structure of standard feeders and the combination feeder described in U.S. patent application Ser. No. 13/400,511, entitled "Article Of Footwear Incorporating A Knitted Component With A Tongue", filed on Feb. 20, 2012, the disclosure of which has been incorporated by reference above.

The manner in which knitting machine 1700 operates to manufacture a knitted component will now be discussed in detail. Moreover, the following discussion will demonstrate the operation of one or more standard feeders 1720 and/or combination feeders 1722 during a knitting process. The knitting process discussed herein relates to the formation of various knitted components, which may be any knitted component, including knitted components that are similar to knitted components in the embodiments described above. For purposes of the discussion, only a relatively small section of a knitted component may be shown in the figures in order to permit the knit structure to be illustrated. Moreover, the scale or proportions of the various elements of knitting machine 1700 and a knitted component may be enhanced to better illustrate the knitting process. It should be understood that although a knitted component is formed between needle beds 1701, 1702, for purposes of illustration in FIGS. 18 through 29, a knitted component is shown adjacent to needle beds 1701, 1702 to (a) be more visible during discussion of the knitting process and (b) show the position of portions of the knitted component relative to each other and needle beds 1701, 1702. Also, although one rail, and limited numbers of standard feeders and combination feeders are depicted, additional rails, standard feeders, and combination feeders may be used. Accordingly, the general structure of knitting machine 1700 is simplified for purposes of explaining the knitting process.

Figure 18:
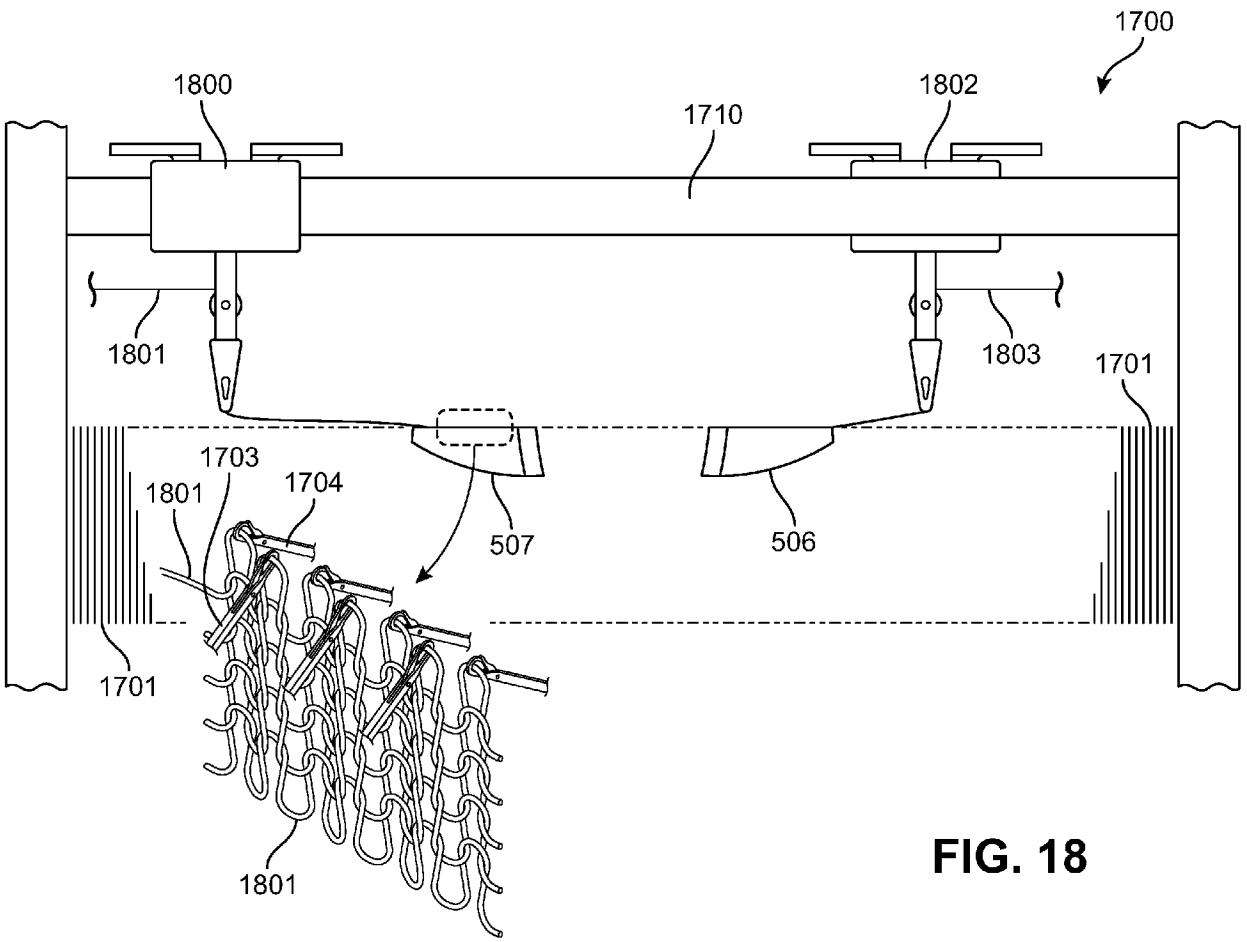
FIG. 18 is a schematic view of internal components of the knitting machine in operation.

FIGS. 18 through 21 illustrate an exemplary process of knitting a knitted component in the form of first knitted component 500, described above. Referring to FIG. 18, a portion of knitting machine 1700 that includes needles 1703 associated with front needle bed 1701, needles 1704 associated with back needle bed 1702, and forward rail 1710 is shown. Additionally, in this embodiment, knitting machine 1700 may include a first standard feeder 1800 and a second standard feeder 1802 that are substantially similar to standard feeder 1720, described above. First standard feeder 1800 may be secured to a front side of front rail 1710 and second standard feeder 1802 may be secured to a rear side of front rail 1710. In other embodiments, additional feeders may be used and may be located on the front or rear side of front rail 1710 and/or rear rail 1711.

In this embodiment, a first yarn 1801 from a spool (not shown) passes through first standard feeder 1800 and an end of yarn 1801 extends outward from a dispensing tip at the end of first standard feeder 1800. Although yarn 1801 is depicted, any other strand (e.g., filament, thread, rope, webbing, cable, chain, or yarn) may pass through first standard feeder 1800. A second yarn 1803 similarly passes through second standard feeder 1802 and extends outward from a dispensing tip. In an exemplary embodiment, first yarn 1801 and second yarn 1803 may be used to form portions of first knitted component 500. In this embodiment, loops of first yarn 1801 are shown forming an uppermost course of medial heel edge 507 of first knitted component 500 and are held by hooks located on ends of needles 1703 and needles 1704. Similarly, loops of second yarn 1803 may be used to form lateral heel edge 506 of first knitted component 500.

Figure 19:
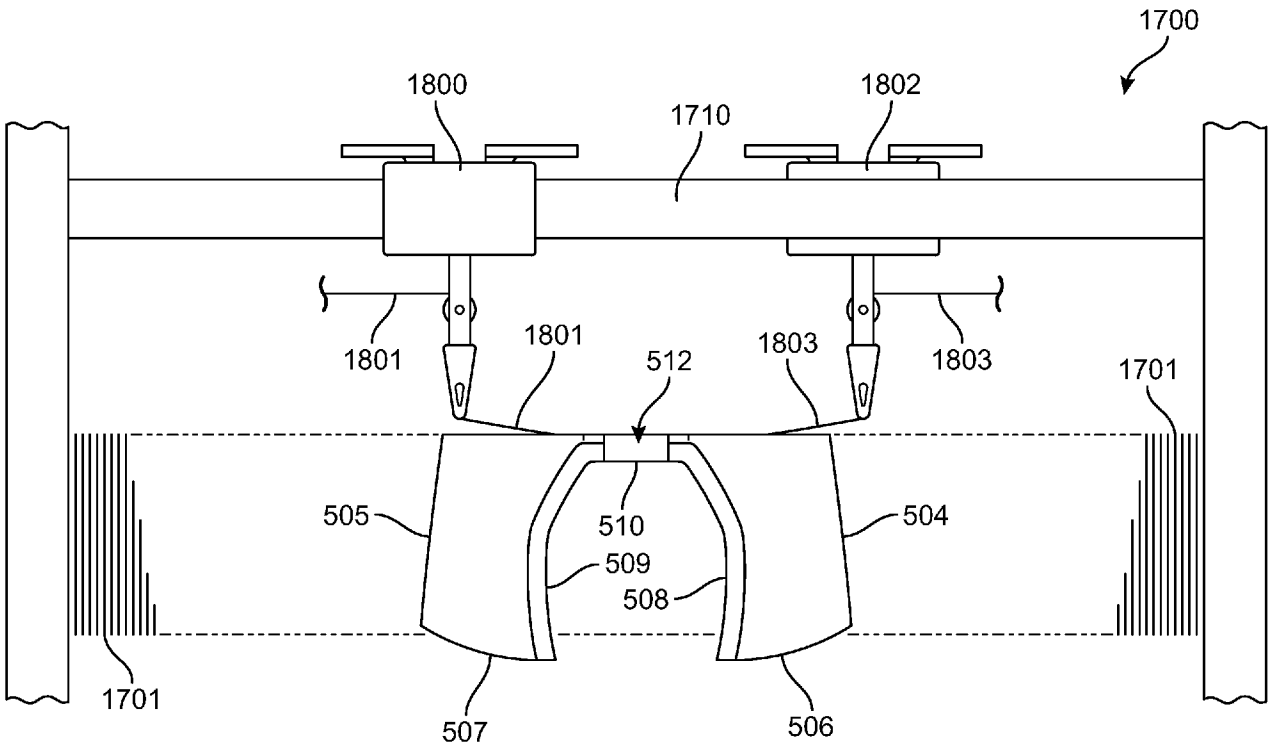
FIG. 19 is a schematic view of internal components of the knitting machine in operation to manufacture a knitted component with an integral knit tongue.
Figure 20:
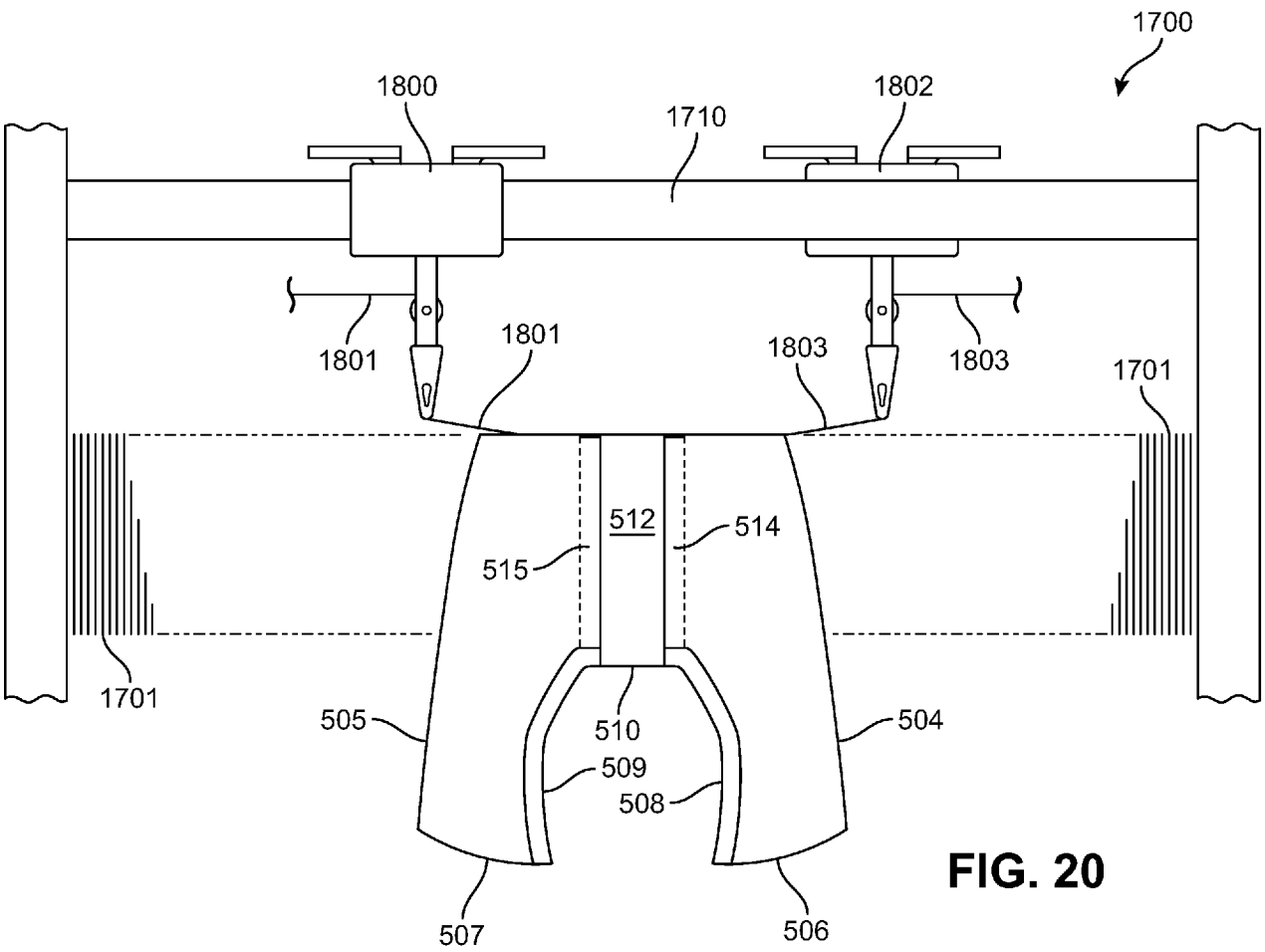
FIG. 20 is a schematic view of internal components of the knitting machine in operation to manufacture a knitted component with an integral knit tongue.
Figure 21:
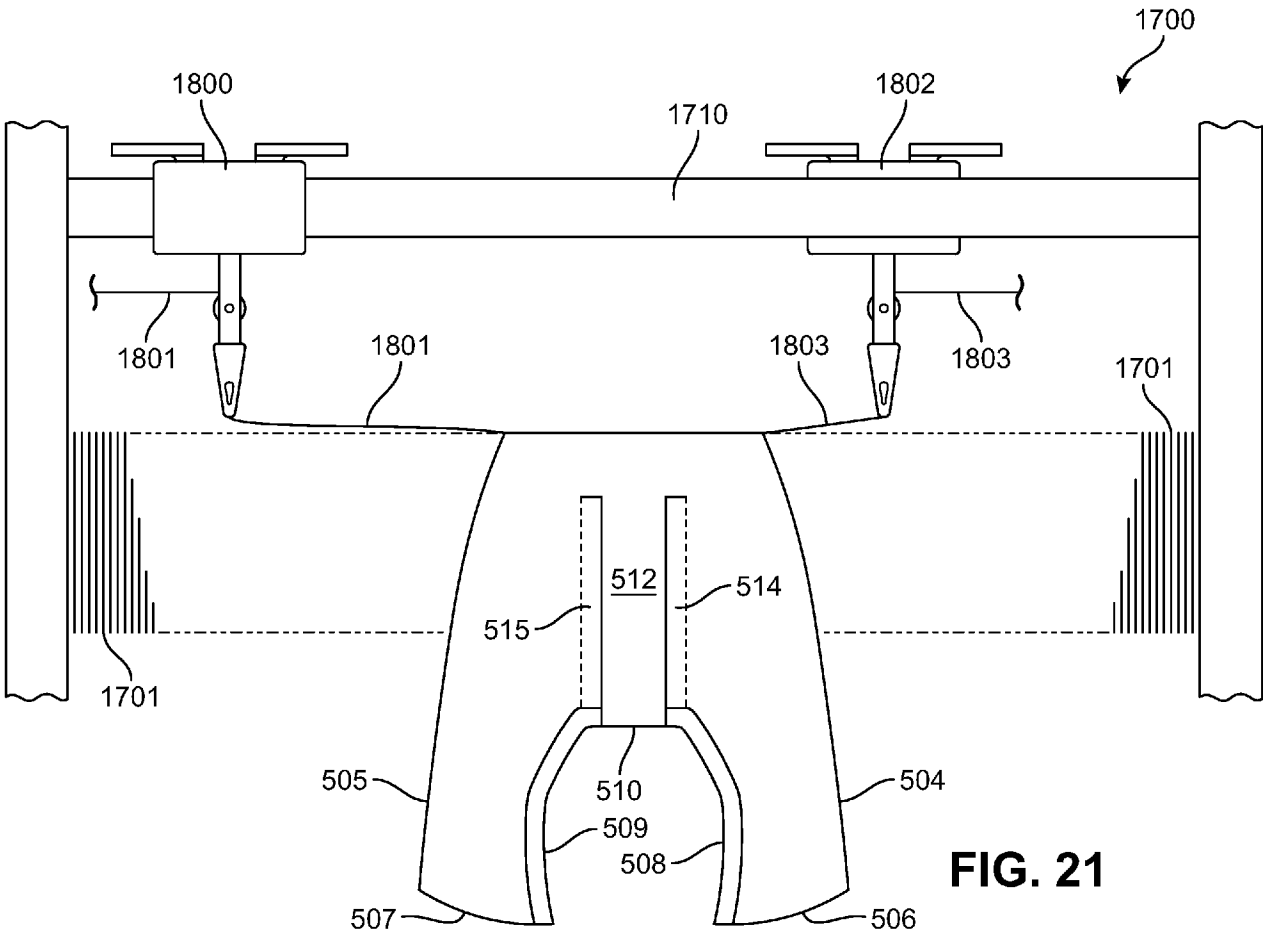
FIG. 21 is a schematic view of internal components of the knitting machine in operation to manufacture a knitted component with an integral knit tongue.

Next, as shown in FIG. 19, knitting machine 1700 may use a similar process to add additional courses to the material forming first knitted component 500 to form further portions, including lateral perimeter edge 504, medial perimeter edge 505, lateral inner edge 508, medial inner edge 509, and front inner edge 510 of integral knit tongue 512. In this embodiment, first standard feeder 1800 and second standard feeder 1802 may form integral knit tongue 512 according to the loop diagram illustrated in FIG. 16, above. FIG. 20 illustrates knitting machine 1700 completing the courses associated with knitting integral knit tongue 512, lateral raised element 514, medial raised element 515, and a portion of the rest of first knitted component 500 forming upper 502. FIG. 21 illustrates knitting machine 1700 nearly completing the knitting process of forming first knitted component 500. By adding additional courses using a similar process, first knitted component 500 may be completed.

Figure 22:
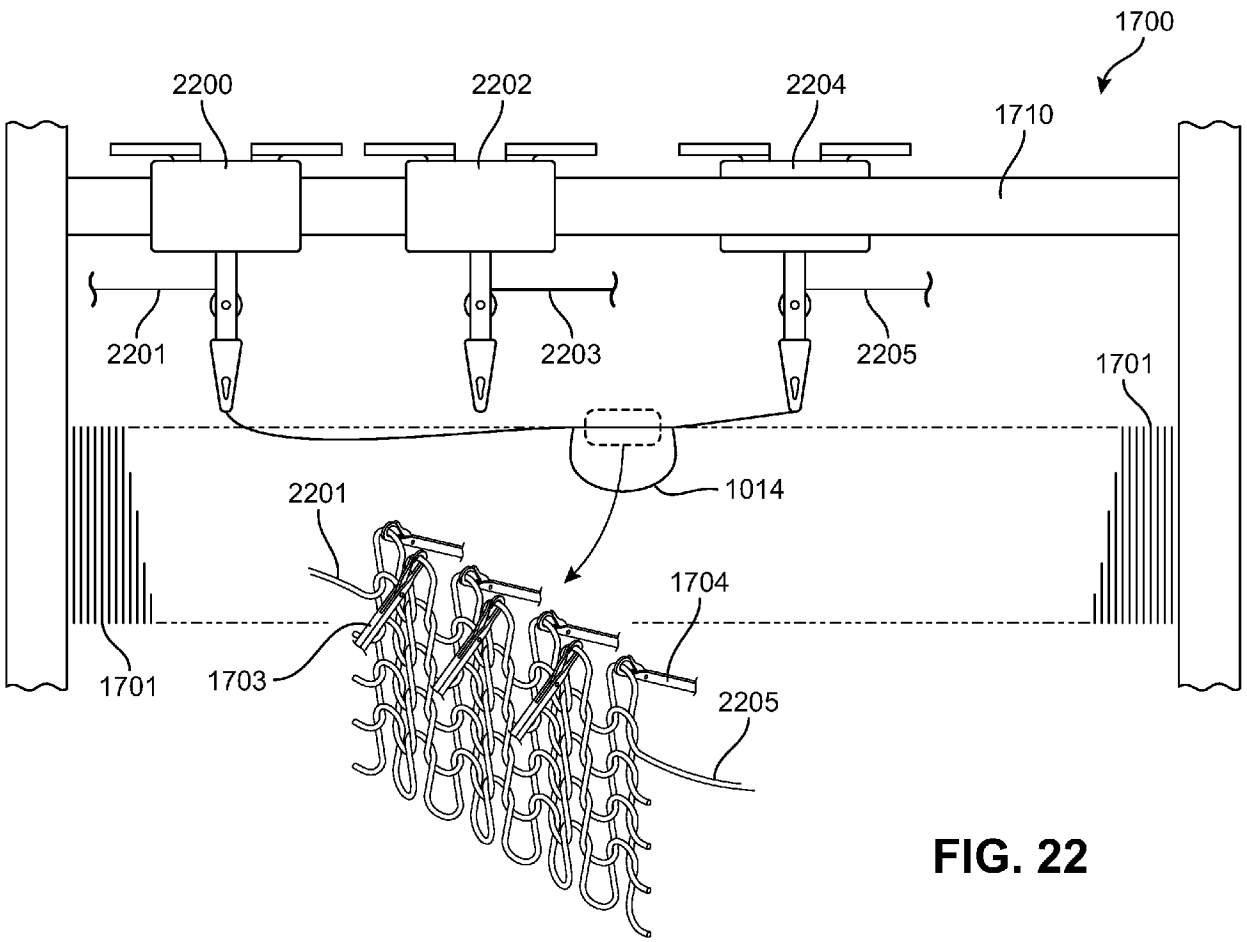
FIG. 22 is a schematic view of internal components of the knitting machine in operation to manufacture a knitted component with an integral knit tongue having a partially integral portion.

FIGS. 22 through 25 illustrate an exemplary process of knitting a knitted component in the form of third knitted component 1000, described above. Referring to FIG. 22, a portion of knitting machine 1700 that includes needles 1703 associated with front needle bed 1701, needles 1704 associated with back needle bed 1702, and forward rail 1710 is shown. Additionally, in this embodiment, knitting machine 1700 may include a first standard feeder 2200 and a second standard feeder 2204 that are substantially similar to standard feeder 1720, described above and a combination feeder 2202 that is substantially similar to combination feeder 1722, described above. First standard feeder 1800 and combination feeder 2202 may be secured to a front side of front rail 1710 and second standard feeder 2204 may be secured to a rear side of front rail 1710. In other embodiments, additional feeders may be used and may be located on the front or rear side of front rail 1710 and/or rear rail 1711.

In this embodiment, a first yarn 2201 from a spool (not shown) passes through first standard feeder 2200 and an end of yarn 2201 extends outward from a dispensing tip at the end of first standard feeder 2200. Although yarn 2201 is depicted, any other strand (e.g., filament, thread, rope, webbing, cable, chain, or yarn) may pass through first standard feeder 2200. A second yarn 2205 similarly passes through second standard feeder 2204 and extends outward from a dispensing tip. A third yarn 2203 passes through combination feeder 2202 to a dispensing tip. In an exemplary embodiment, third yarn 2203 may be a different type of yarn than first yarn 2201 and/or second yarn 2205. In this embodiment, third yarn 2203 may be a tensile element or other inlaid strand. In an exemplary embodiment, first yarn 2201 and second yarn 2205 may be used to form portions of a knit element of third knitted component 1000, whereas third yarn 2203 may be inlaid within the knit element as a tensile element of third knitted component 1000. In other embodiments, however, third yarn 2203 may be used to form portions of a knit element of third knitted component 1000.

Figure 23:
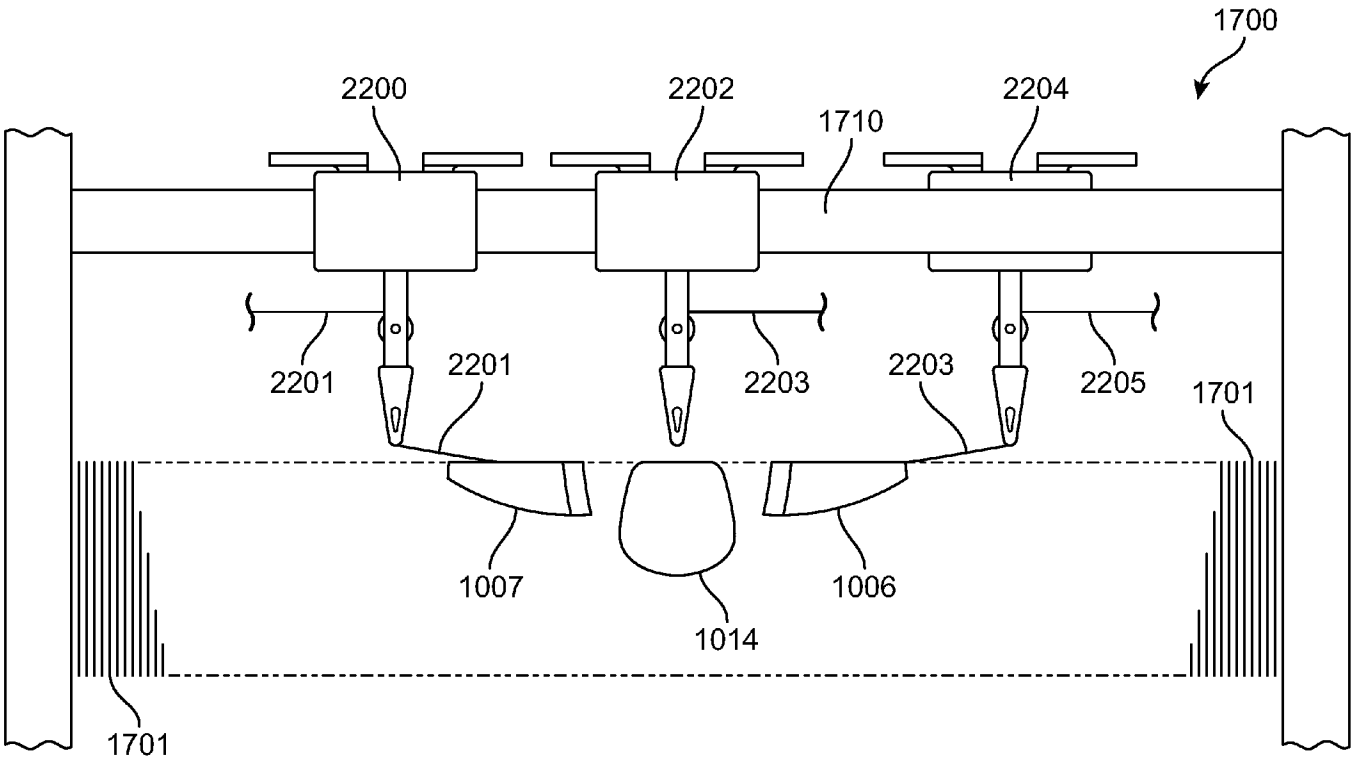
FIG. 23 is a schematic view of internal components of the knitting machine in operation to manufacture a knitted component with an integral knit tongue having a partially integral portion.

In this embodiment, loops of first yarn 2201 and loops of second yarn 2205 are shown forming free portion 1014 of integral knit tongue 1010 of third knitted component 1000 and are held by hooks located on ends of needles 1703 and needles 1704. Additionally, FIG. 23 illustrates knitting machine 1700 completing the courses forming free portion 1014. In some embodiments, at least the final course of free portion 1014 may include cross-tuck stitches with a relatively tight or dense knit to ensure that free portion 1014 of integral knit tongue 1010 remains properly positioned on needles 1701, 1702 during later stages of the knitting process to be joined with the remaining portion of integral knit tongue 1010.

Knitting machine 1700 now begins the process of forming the remaining portion of the knit element forming third knitted component 1000, in accordance with a similar knitting process discussed above. In an exemplary embodiment, loops of first yarn 2201 may then begin to form an uppermost course of medial heel edge 1007 of third knitted component 1000 and loops of second yarn 2205 may be used to form lateral heel edge 1006 of third knitted component 1000.

Figure 24:
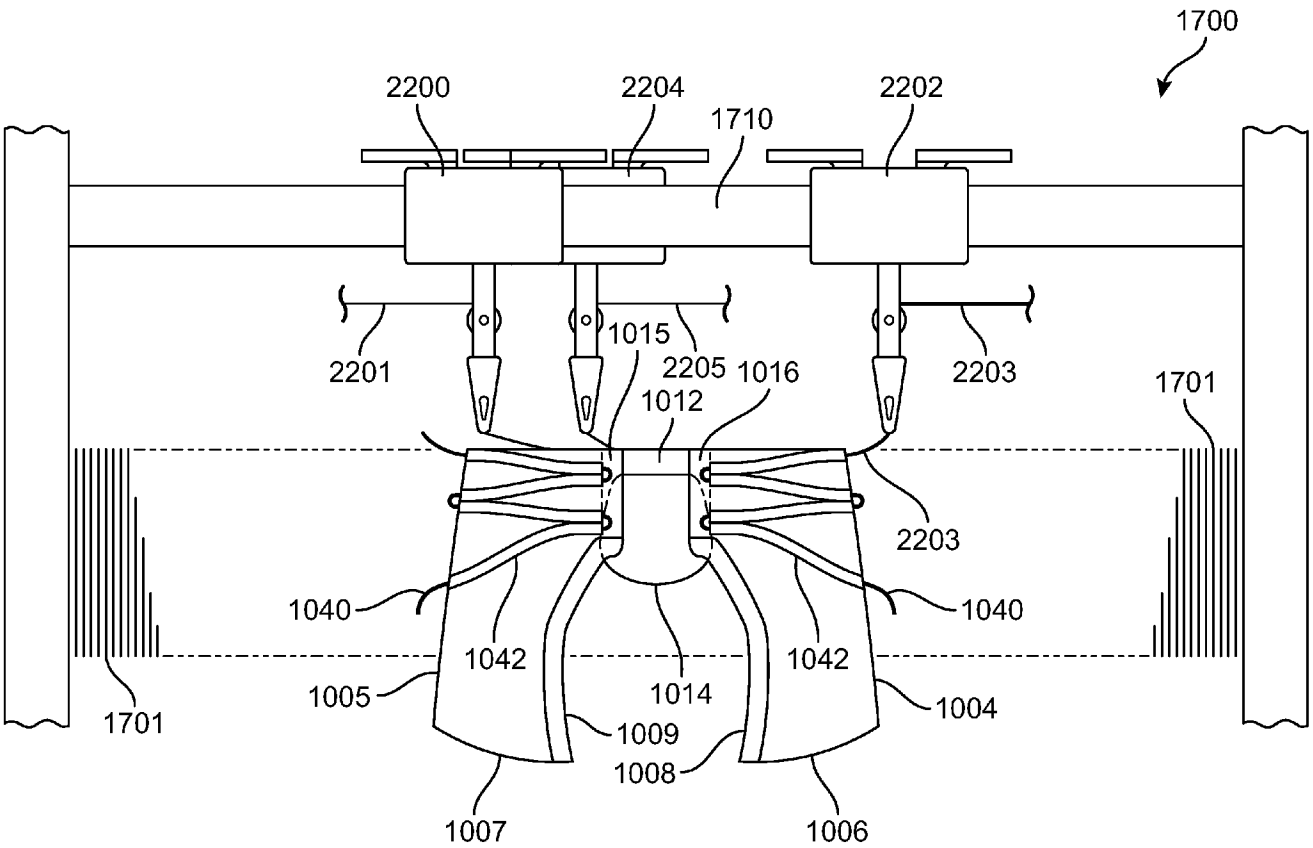
FIG. 24 is a schematic view of internal components of the knitting machine in operation to manufacture a knitted component with an integral knit tongue having a partially integral portion.

Referring now to FIG. 24, as the knitting process continues, first standard feeder 2200 and second standard feeder 2204 may continue adding courses to third knitting component 1000, including lateral perimeter edge 1004, medial perimeter edge 1005, lateral inner edge 1008, medial inner edge 1009, and partially integral portion 1012 of integral knit tongue 1010. In this embodiment, first standard feeder 2200 and second standard feeder 2204 may form partially integral portion 1012 of integral knit tongue 1010 according to the loop diagram illustrated in FIG. 16, above. Additionally, in this embodiment, combination feeder 2202 inlays third yarn 2203 to form tensile element 1040, as depicted in FIG. 24, also in accordance with the knitting process discussed in the Inlaid Strand cases.

Figure 25:
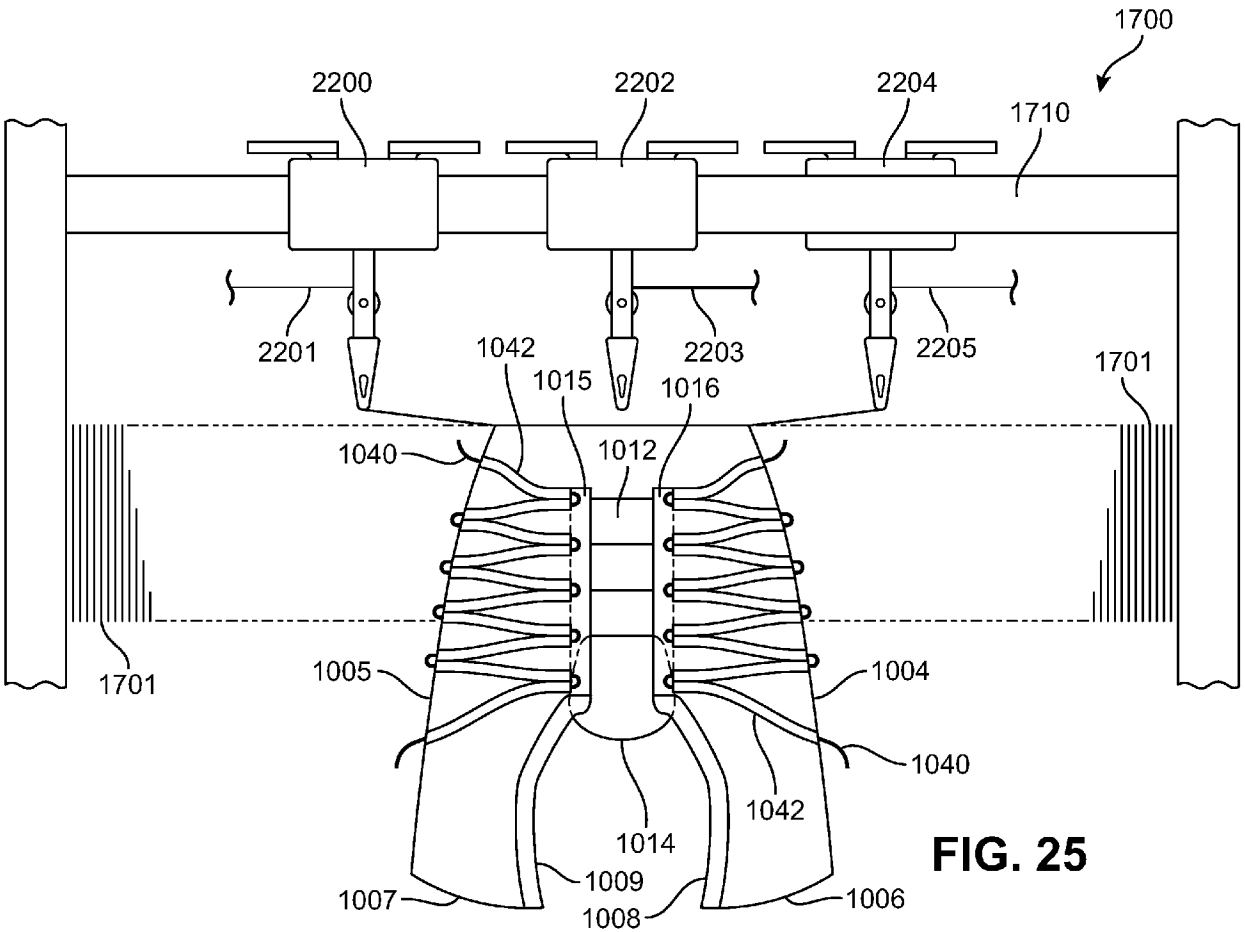
FIG. 25 is a schematic view of internal components of the knitting machine in operation to manufacture a knitted component with an integral knit tongue having a partially integral portion.

In an exemplary embodiment, during the knitting process depicted between FIG. 23 and FIG. 24, free portion 1014 of integral knit tongue 1010 may remain stationary relative to needle beds 1701, 1702, as the portions of third knitted component 1000 move downward and may overlap free portion 1014 as successive courses are formed in third knitted component 1000. This continues until a course is formed that is intended to join free portion 1014 to the partially integral portion 1012 of integral knit tongue 1010 formed with the rest of third knitted component 1000. FIG. 25 illustrates knitting machine 1700 nearly completing the knitting process of forming third knitted component 1000. By adding additional courses using a similar process, third knitted component 1000 may be completed.

Additionally, in the knitting process depicted in FIGS. 22 through 25, the relative position of the various feeders on first rail 1710 may restrict the portions of third knitted component 1000 that may be formed by each respective feeder. For example, because of the placement of combination feeder 2202, first standard feeder 2200 may be permitted to form both a front and back portion (associated with first surface 1030 and second surface 1032, respectively) of third knitted component 1000 along a medial side and across partially integral portion 1012 of integral knit tongue 1010, but be restricted from forming a portion of third knitted component 1000 along a lateral side. Similarly, second standard feeder 2204 may be permitted to form both the front and back portion of third knitted component 1000 along the lateral side and across partially integral portion 1012 of integral knit tongue 1010, but be restricted from forming a portion of third knitted component 1000 along the medial side. With this arrangement, the knitting process depicted in FIGS. 22-25 may require that specific feeders are used to form specific portions of third knitted component 1000.

Figure 26:
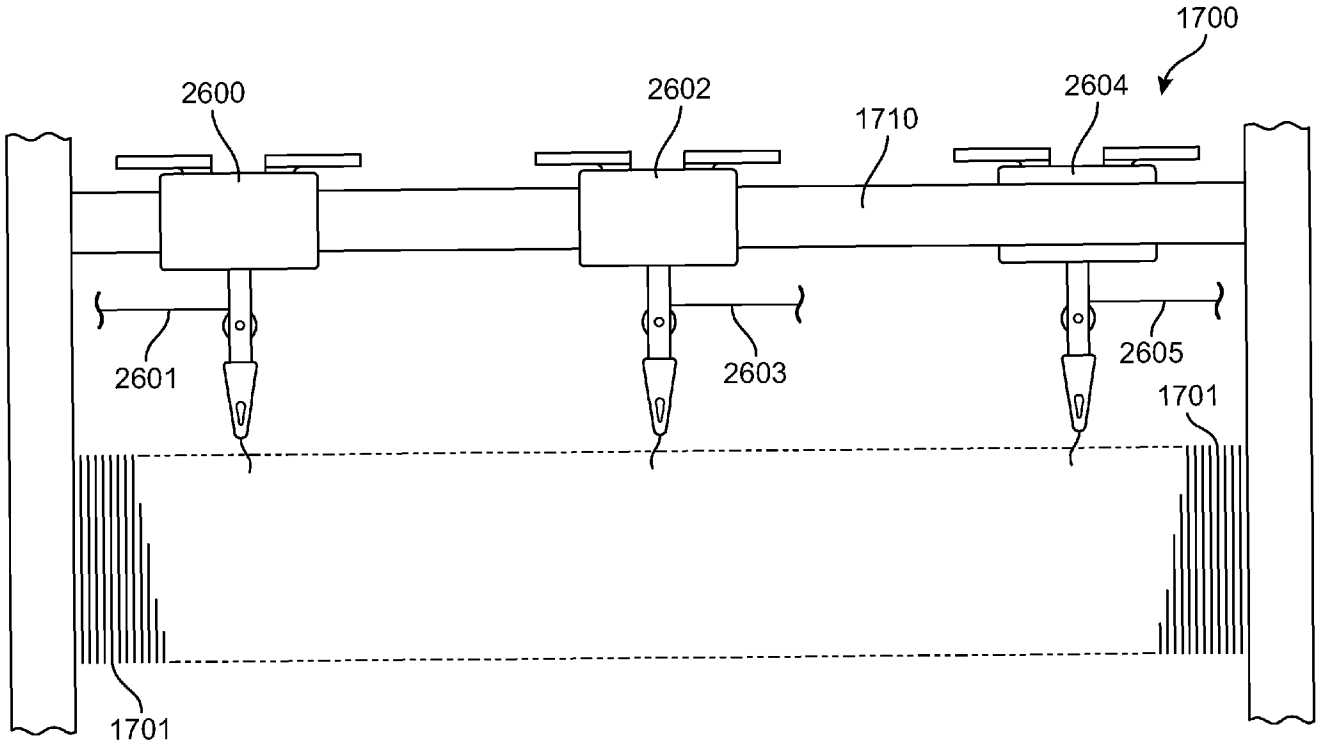
FIG. 26 is a schematic view of internal components of the knitting machine in operation to manufacture a knitted component with an integral knit tongue having partially decoupled knit layers.

FIGS. 26 through 29 illustrate an exemplary process of knitting a knitted component similar to fourth knitted component 1300, described above. Referring to FIG. 26, a portion of knitting machine 1700 that includes needles 1703 associated with front needle bed 1701, needles 1704 associated with back needle bed 1702, and forward rail 1710 is shown. Additionally, in this embodiment, knitting machine 1700 may include a first standard feeder 2600, a second standard feeder 2602, and a third standard feeder 2604 that are substantially similar to standard feeder 1720, described above. In addition, in embodiments where fourth knitted component 1300 includes tensile elements, a combination feeder (not shown) that is substantially similar to combination feeder 1722, described above, may be included to form tensile element 1340 according to the process described above with regard to the knitting process of third knitted component 1000 and as described in the Inlaid Strand cases. For the purposes of ease of illustration, therefore, fourth knitted component 1300 will be illustrated in FIGS. 26 through 29 without tensile element 1340.

Referring again to FIG. 26, first standard feeder 2600 and second standard feeder 2602 may be secured to a front side of front rail 1710 and third standard feeder 2604 may be secured to a rear side of front rail 1710. In other embodiments, additional feeders may be used and may be located on the front or rear side of front rail 1710 and/or rear rail 1711.

In this embodiment, a first yarn 2601 from a spool (not shown) passes through first standard feeder 2600 and an end of yarn 2601 extends outward from a dispensing tip at the end of first standard feeder 2600. Although yarn 2601 is depicted, any other strand (e.g., filament, thread, rope, webbing, cable, chain, or yarn) may pass through first standard feeder 2600. A second yarn 2603 similarly passes through second standard feeder 2602 and extends outward from a dispensing tip. A third yarn 2605 also passes through third standard feeder 2604 to a dispensing tip in a similar manner. In an exemplary embodiment, second yarn 2603 may be a different type of yarn than first yarn 2601 and/or third yarn 2605. In this embodiment, second yarn 2603 may be an elastic yarn that has a larger amount or degree of elasticity than first yarn 2601 and/or third yarn 2605, which may be a substantially inelastic yarn or a yarn with a small amount or degree of elasticity. In an exemplary embodiment, first yarn 2601 and third yarn 2605 may be used to form lateral and medial portions of a knit element forming fourth knitted component 1300, whereas second yarn 2603 may be used to form the elastic portion of integral knit tongue 1310 that is centrally-located within throat area 1320 of fourth knitted component 1300. In other embodiments, however, second yarn 2603 may be further used to form other portions of the knit element of fourth knitted component 1300.

Figure 27:
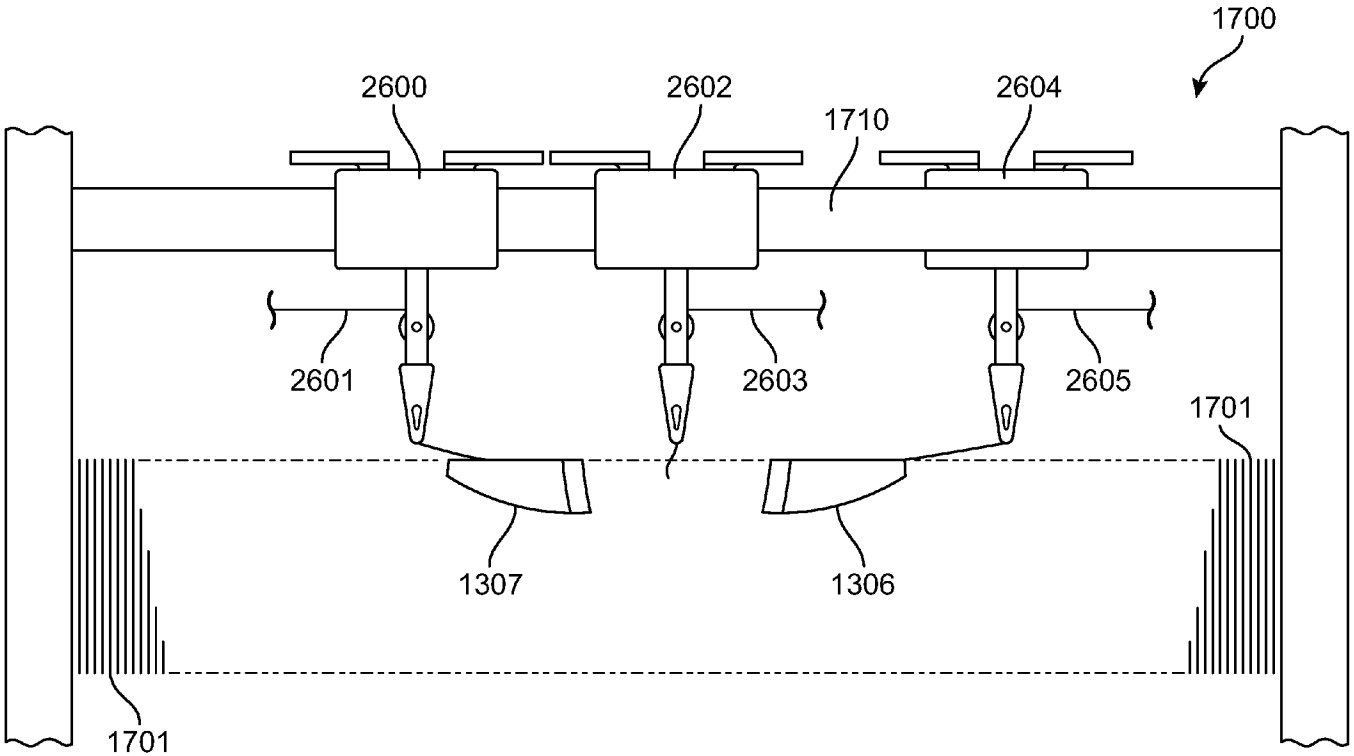
FIG. 27 is a schematic view of internal components of the knitting machine in operation to manufacture a knitted component with an integral knit tongue having partially decoupled knit layers.
Figure 28:
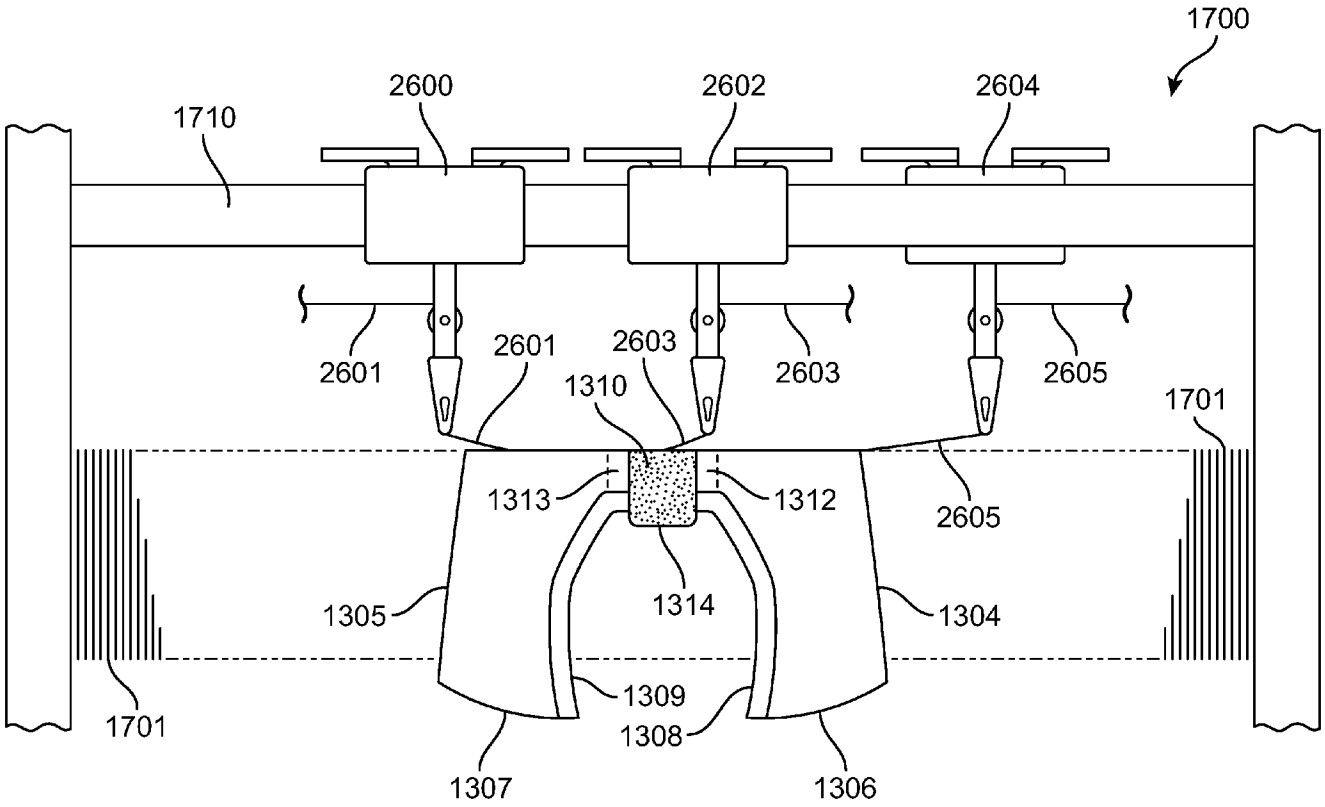
FIG. 28 is a schematic view of internal components of the knitting machine in operation to manufacture a knitted component with an integral knit tongue having partially decoupled knit layers.

Referring now to FIG. 27, loops of first yarn 2601 are shown forming an uppermost course of medial heel edge 1307 of fourth knitted component 1300 and loops of third yarn 2605 may be used to form lateral heel edge 1306 of fourth knitted component 1300. Second yarn 2603 may not yet be used to form any portion of fourth knitted component 1300. Next, as shown in FIG. 28, knitting machine 1700 may use a similar process to add additional courses to the material forming fourth knitted component 1300 to form further portions, including lateral perimeter edge 1304, medial perimeter edge 1305, lateral inner edge 1308, and medial inner edge 1309. In addition, at this point, second standard feeder 2602 may have begun to use second yarn 2603 to form portions of fourth knitted component 1300, including integral knit tongue 1312, which extends from needles 1701, 1702 to the completed top end 1314.

Figure 29:
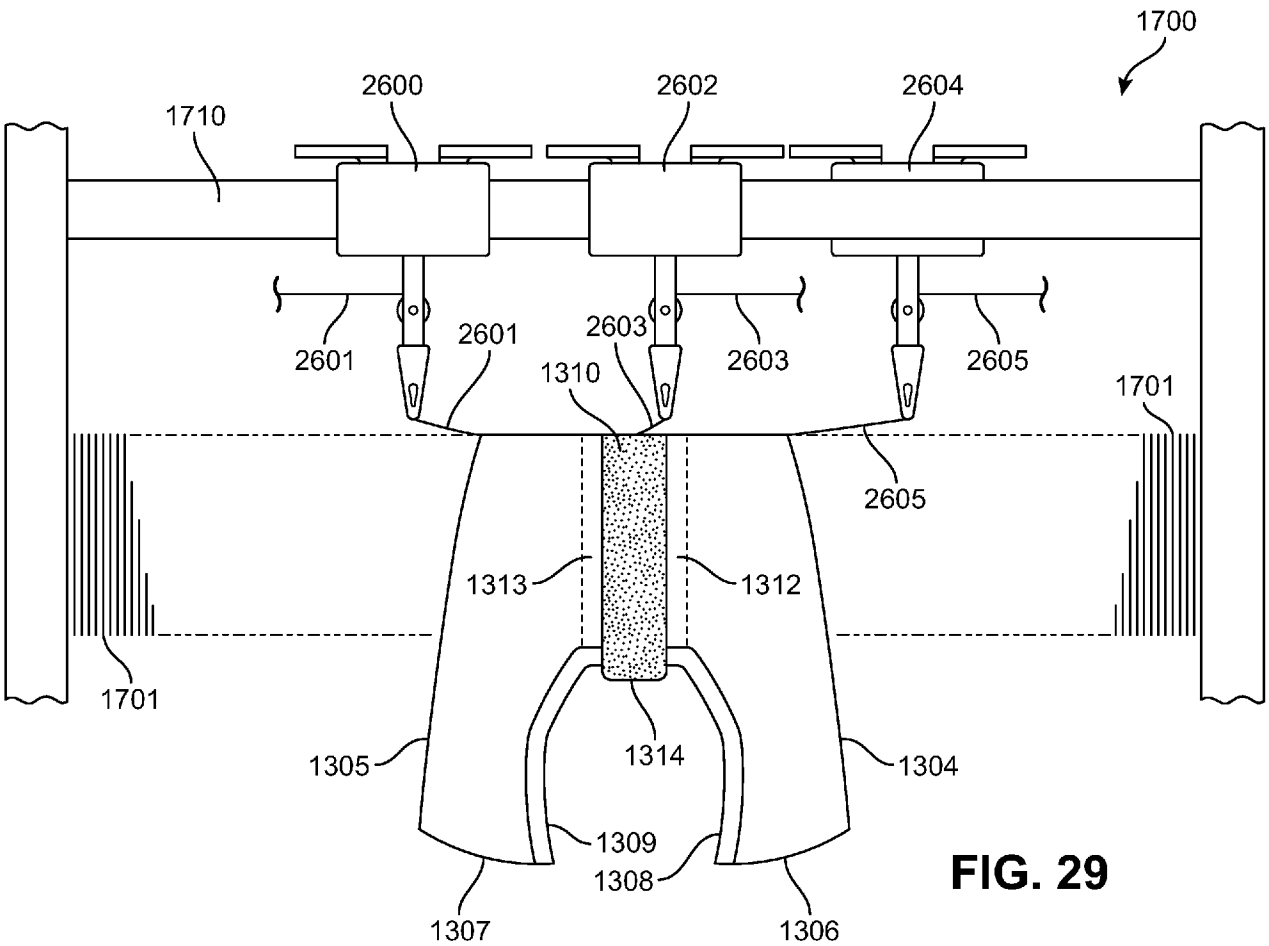
FIG. 29 is a schematic view of internal components of the knitting machine in operation to manufacture a knitted component with an integral knit tongue having partially decoupled knit layers.

In this embodiment, second standard feeder 2602 may form integral knit tongue 1310 using an elastic yarn so as to permit throat area 1320 of fourth knitted component 1300 to stretch. In addition, fourth knitted component 1300 may be formed with one or more decoupled knit layers, as described above. FIG. 29 illustrates knitting machine 1700 completing the courses associated with knitting integral knit tongue 1310 and the rest of fourth knitted component 1300 forming upper 1302. By adding additional courses using a similar process, fourth knitted component 1300 may be completed.

Additionally, in the knitting process depicted in FIGS. 26 through 29, the relative position of the various feeders on first rail 1710 may restrict the portions of fourth knitted component 1300 that may be formed by each respective feeder. For example, because the placement of second standard feeder 2602 is needed to form integral knit tongue 1310 with an elastic second yarn 2603, first standard feeder 2600 may be permitted to form both a front and back portion (associated with first surface 1330 and second surface 1332, respectively) of fourth knitted component 1300 along only a medial side of fourth knitted component 1300. Similarly, third standard feeder 2604 may be permitted to form both the front and back portion of fourth knitted component 1300 along only a lateral side of fourth knitted component 1300. Accordingly, second standard feeder 2602 may be used to form integral knit tongue 1310 spanning between the lateral side and the medial side of fourth knitted component 1300. With this arrangement, the knitting process depicted in FIGS. 26-29 may require that specific feeders are used to form specific portions of fourth knitted component 1300.

The processes and methods for knitting a knitted component described above and illustrated in FIGS. 16 through 29 are exemplary and are not meant to be exhaustive. Therefore, it should be understood that additional knitted components including the features of the embodiments described herein, as well as similar knitted components not explicitly described herein, may be made using one or more knitting processes that are substantially similar to the knitting methods for knitted components described above and/or in the Inlaid Strands cases.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A method of manufacturing a knitted component for an article of footwear, the method comprising:

knitting a portion of the knitted component defining an upper with a knitting machine, the upper including a portion of at least one of an exterior surface of the knitted component and an opposite interior surface of the knitted component; and knitting an integral knit tongue that is of unitary knit construction with the upper with the knitting machine, the integral knit tongue extending through a throat area of the knitted component; and wherein the integral knit tongue is joined by knitting with the knitting machine to: (1) a forward portion of the throat area, and (2) at least along a portion of both of a lateral side and a medial side of the throat area of the knitted component extending through a portion of a length of the throat area in a longitudinal direction from the forward portion to an ankle opening of the upper.

2. The method recited in claim 1, further including a step of selecting the knitting machine to be a flat knitting machine.

3. The method recited in claim 1, wherein the step of knitting the integral knit tongue includes forming a course of the integral knit tongue to include at least one common yarn with the upper.

4. The method recited in claim 1, wherein the step of joining the integral knit tongue by knitting includes forming a course with the knitting machine that joins the integral knit tongue to the upper.

5. The method recited in claim 1, wherein the integral knit tongue comprises a partially integral portion and a free portion, the method further comprising:

knitting the partially integral portion with the knitting machine of unitary knit construction with the upper at the forward portion of the throat area and at least along the portion of both of the lateral side and the medial side of the throat area of the knitted component extending through the portion of the length of the throat area in the longitudinal direction; and knitting the free portion with the knitting machines of unitary knit construction with the partially integral portion at a rearward portion of the integral knit tongue and remaining unattached to the remaining portions of the knitted component.

6. The method recited in claim 5, wherein the step of knitting the free portion further comprises:

knitting the free portion of the integral knit tongue with the knitting machine;

holding the free portion on needles of the knitting machine;

knitting a first portion of the upper with the knitting machine while the free portion is held on the needles, the first portion of the upper including at least the rearward portion of the integral knit tongue;

joining the free portion to the integral knit tongue at the rearward portion; and knitting a second portion of the upper with the knitting machine.

7. The method recited in claim 6, wherein the step of knitting the first portion further comprises holding the free portion stationary with respect to a needle bed of the knitting machine during knitting of the first portion of the upper, and the first portion of the upper moving with respect to the free portion during knitting of the first portion of the upper;

wherein the step of joining the free portion includes forming a course with the knitting machine that joins the free portion to the integral knit tongue; and wherein the step of knitting the second portion further comprises moving the free portion and the upper together during knitting of the second portion of the upper.

8. A method of manufacturing a knitted component for an article of footwear, the method comprising:

knitting a first portion of the knitted component defining an upper with a first feeder of a knitting machine, the upper including a portion of at least one of an exterior surface of the knitted component and an opposite interior surface of the knitted component;

knitting a second portion of the knitted component defining the upper with a second feeder of the knitting machine; and knitting an integral knit tongue that is of unitary knit construction with the upper with at least one of the first feeder and the second feeder of the knitting machine, the integral knit tongue extending through a throat area of the knitted component; and wherein the integral knit tongue is joined by knitting with the knitting machine to: (1) a forward portion of the throat area, and (2) at least along a portion of both of a lateral side and a medial side of the throat area of the knitted component extending through a portion of a length of the throat area in a longitudinal direction from the forward portion to an ankle opening of the upper.

9. The method recited in claim 8, wherein the step of knitting the first portion further comprises:

knitting the exterior surface of the first portion of the upper with the first feeder;

knitting the opposite interior surface of the first portion of the upper with the first feeder; and knitting at least a portion of the integral knit tongue with the first feeder.

10. The method recited in claim 9, wherein the step of knitting the second portion further comprises:

knitting the exterior surface of the first portion of the upper with the second feeder;

knitting the opposite interior surface of the second portion of the upper with the second feeder; and knitting at least a portion of the integral knit tongue with the second feeder.

11. The method recited in claim 8, wherein the first portion of the upper is one of a medial side and a lateral side of the knitted component.

12. The method recited in claim 8, wherein the step of knitting the integral knit tongue includes forming a course of the integral knit tongue to include at least one common yarn with the upper.

13. The method recited in claim 12, further comprising forming at least one course of the first portion of the upper or the second portion of the upper with the knitting machine that is substantially continuous with at least one course of the integral knit tongue at the forward portion of the throat area of the upper.

14. The method recited in claim 12, further comprising:

forming at least one course of the first portion of the upper that is substantially continuous with at least one course of the integral knit tongue along the lateral side of the throat area of the upper; and forming at least one course of the second portion of the upper that is substantially continuous with at least one course of the integral knit tongue along the medial side of the throat area of the upper.

15. The method recited in claim 8, wherein the integral knit tongue comprises a partially integral portion and a free portion, the method further comprising:

knitting the free portion of the integral knit tongue with at least one feeder of the knitting machine;

holding the free portion on needles of the knitting machine;

knitting the first portion of the upper with the first feeder of the knitting machine and knitting the second portion of the upper with the second feeder while the free portion is held on the needles, the first portion of the upper and the second portion of the upper including at least a rearward portion of the integral knit tongue;

joining the free portion to the integral knit tongue at the rearward portion; and resuming knitting the first portion of the upper with the first feeder of the knitting machine and resuming knitting the second portion of the upper with the second feeder of the knitting machine.

16. A method of manufacturing a knitted component for an article of footwear, the method comprising:

knitting a first portion of the knitted component defining an upper with a first feeder of a knitting machine, the upper including a portion of at least one of an exterior surface of the knitted component and an opposite interior surface of the knitted component;

knitting a second portion of the knitted component defining the upper with a second feeder of the knitting machine; and knitting an integral knit tongue that is of unitary knit construction with the upper with a third feeder of the knitting machine, the integral knit tongue extending through a throat area of the knitted component; and wherein the integral knit tongue is joined by knitting with the knitting machine to: (1) a forward portion of the throat area, and (2) at least along a portion of both of a lateral side and a medial side of the throat area of the knitted component extending through a portion of a length of the throat area in a longitudinal direction from the forward portion to an ankle opening of the upper.

17. The method recited in claim 16, wherein the upper comprises a first type of yarn; and wherein the integral knit tongue comprises a second type of yarn, the second type of yarn being different from the first type of yarn.

18. The method recited in claim 17, wherein the second type of yarn is an elastic yarn.

19. The method recited in claim 16, wherein the step of knitting the integral knit tongue includes forming a course of the integral knit tongue to include at least one common yarn with the upper.

20. The method recited in claim 19, further comprising forming at least one course of the first portion of the upper or the second portion of the upper with the knitting machine that is substantially continuous with at least one course of the integral knit tongue at the forward portion of the throat area of the upper.

21. The method recited in claim 19, further comprising:

forming at least one course of the first portion of the upper that is substantially continuous with at least one course of the integral knit tongue along the lateral side of the throat area of the upper; and forming at least one course of the second portion of the upper that is substantially continuous with at least one course of the integral knit tongue along the medial side of the throat area of the upper.

22. The method recited in claim 16, wherein the step of knitting the first portion further comprises:

knitting the exterior surface of the first portion of the upper with the first feeder; and knitting the opposite interior surface of the first portion of the upper with the first feeder.

23. The method recited in claim 22, wherein the step of knitting the second portion further comprises:

knitting the exterior surface of the first portion of the upper with the second feeder;

knitting the opposite interior surface of the second portion of the upper with the second feeder.

* * * * *

UNITED STATES PATENT AND TRADEMARK OFFICE

CERTIFICATE OF CORRECTION

PATENT NO. : 9,060,562 B2
APPLICATION NO. : 13/781551
DATED : June 23, 2015
INVENTOR(S) : Adrian Meir et al.

It is certified that error appears in the above-identified patent and that said Letters Patent is hereby corrected as shown below:

On the Title Page, item (72) Inventors:

"Adrain Meir" should read --Adrian Meir--

Signed and Sealed this
Eighth Day of December, 2015

Michelle K. Lee

Michelle K. Lee
*Director of the United States Patent and Trademark Office*